US006106111A

United States Patent [19]

Taneya et al.

[11] Patent Number: 6,106,111

[45] Date of Patent: Aug. 22, 2000

[54] LIQUID CONTAINER, HEAD CARTRIDGE, LIQUID EJECTING APPARATUS AND LIQUID EJECTION CONTROL METHOD

[75] Inventors: Yoichi Taneya, Yokohama; Toshio Kashino, Chigasaki, both of Japan

[73] Assignee: Canon Kabushiki Kaisha, Tokyo, Japan

[21] Appl. No.: 08/891,330

[22] Filed: Jul. 10, 1997

[30] Foreign Application Priority Data

Jul. 12, 1996 [JP] Japan ..... 8-183578
Jun. 20, 1997 [JP] Japan ..... 9-164166

[51] Int. Cl.[7] ..... B41J 2/175

[52] U.S. Cl. ..... 347/86; 347/86; 347/87; 347/65; 347/67

[58] Field of Search ..... 347/63, 65, 21, 347/85–87

[56] References Cited

U.S. PATENT DOCUMENTS

| | | | |
|---|---|---|---|
| 4,480,259 | 10/1984 | Kruger et al. | 346/140 R |
| 4,723,129 | 2/1988 | Endo et al. | 346/1.1 |
| 4,855,762 | 8/1989 | Suzuki | 347/86 |
| 4,970,533 | 11/1990 | Saito et al. | 347/86 |
| 4,994,825 | 2/1991 | Saito et al. | 346/140 R |
| 5,208,604 | 5/1993 | Watanabe et al. | 346/1.1 |
| 5,389,957 | 2/1995 | Kimura et al. | 347/20 |
| 5,457,485 | 10/1995 | Moriyama et al. | 347/93 |
| 5,510,884 | 4/1996 | Bov, Jr. et al. | 355/260 |
| 5,821,962 | 10/1998 | Kudo et al. | 347/65 |

FOREIGN PATENT DOCUMENTS

| | | |
|---|---|---|
| 0 412 459 | 2/1991 | European Pat. Off. . |
| 0 436 047 | 7/1991 | European Pat. Off. . |
| 0 610 965 | 8/1994 | European Pat. Off. . |
| 0 623 471 | 11/1994 | European Pat. Off. . |
| 0 655 336 | 5/1995 | European Pat. Off. . |
| 0 721 841 | 7/1996 | European Pat. Off. . |
| 34 05 164 | 8/1985 | Germany . |
| 55-81172 | 6/1980 | Japan . |
| 61-69467 | 4/1986 | Japan . |
| 63-199972 | 8/1988 | Japan . |
| 4-133746 | 5/1992 | Japan . |
| 7-314730 | 12/1995 | Japan . |
| 93/18920 | 9/1993 | WIPO . |

*Primary Examiner*—John Barlow
*Assistant Examiner*—Juanita Stephens
*Attorney, Agent, or Firm*—Fitzpatrick, Cella, Harper & Scinto

[57] ABSTRACT

A liquid ejecting head cartridge includes a liquid ejection head, the liquid ejection head including; a first liquid flow path in fluid communication with an ejection outlet; bubble generation region; second liquid flow path distributed adjacent the first liquid flow path; a movable member disposed faced to the bubble generating region and displaceable between a first position and a second position more remote from the bubble generating region than the first position; wherein the first and second liquid flow paths are capable of being supplied with different first 1 and second liquids, respectively; wherein the movable member is displaced from the first position to the second position by pressure produced by the generation of the bubble in the bubble generating portion to direct the pressure toward the ejection outlet, thus ejecting the liquid through the ejection outlet; and the cartridge further comprising: a liquid container device for supplying the liquid to the liquid ejection cartridge, wherein the liquid container device may have a first liquid container accommodating at least the first liquid, or a second liquid container accommodating third liquid which is different from the first liquid and from the second liquid and which is to be supplied commonly to the first and second liquid flow paths, and wherein the first and second liquid containers are mountable the liquid ejecting head.

20 Claims, 31 Drawing Sheets

FIG. 19(a)
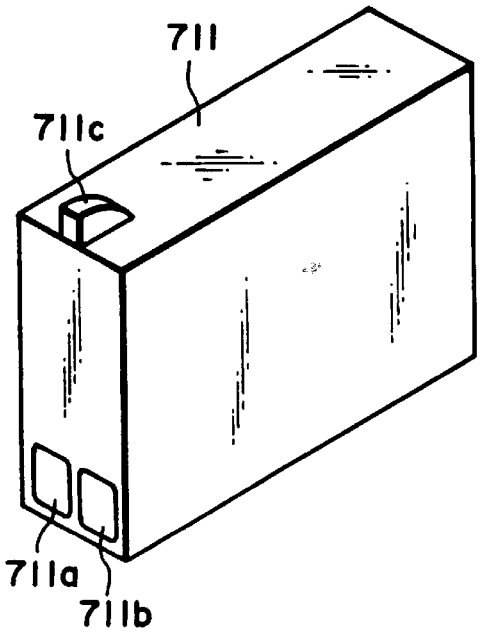
FIG. 19(b)
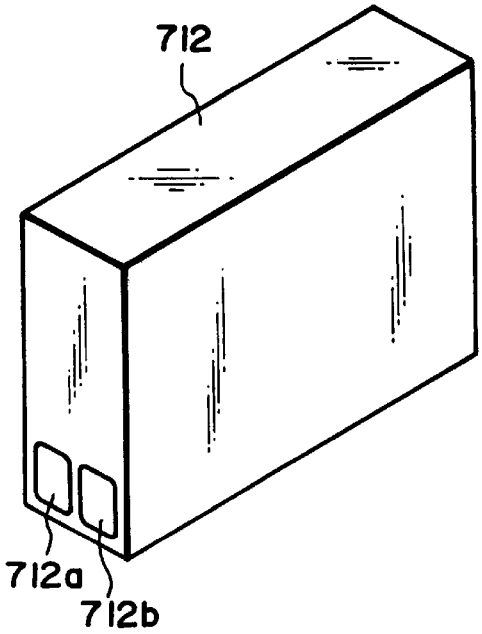
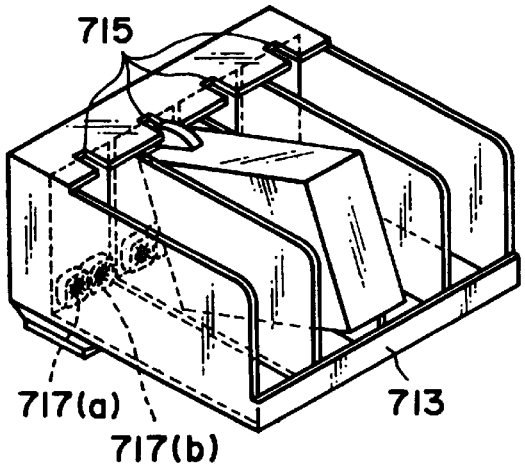
FIG. 19(c)
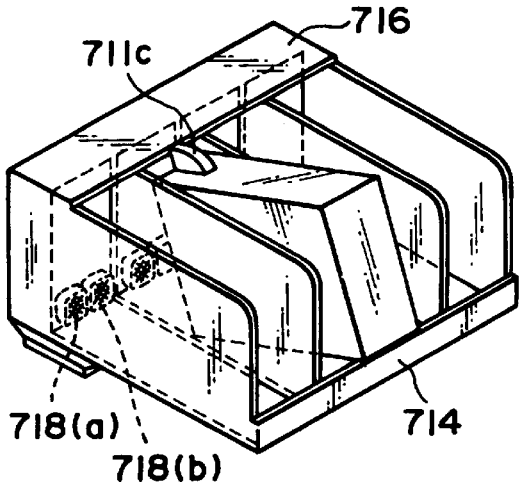
FIG. 19(d)

FIG. 20(a)
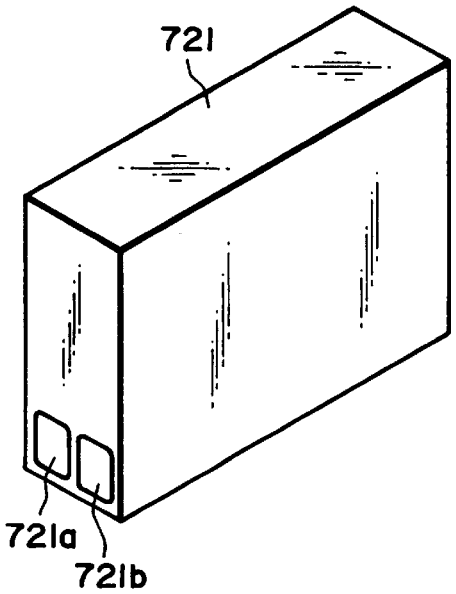
FIG. 20(b)
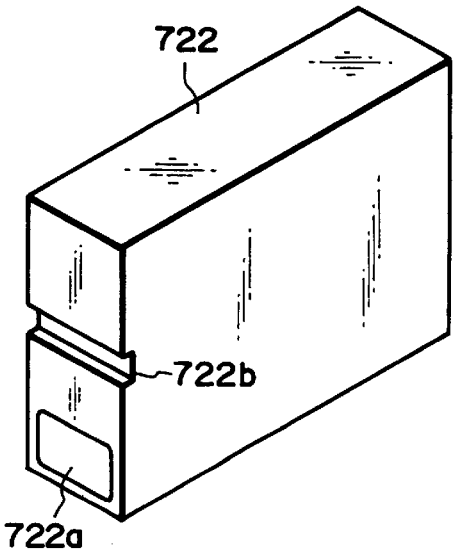
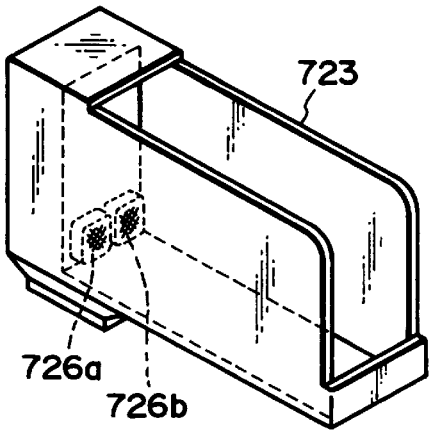
FIG. 20(c)
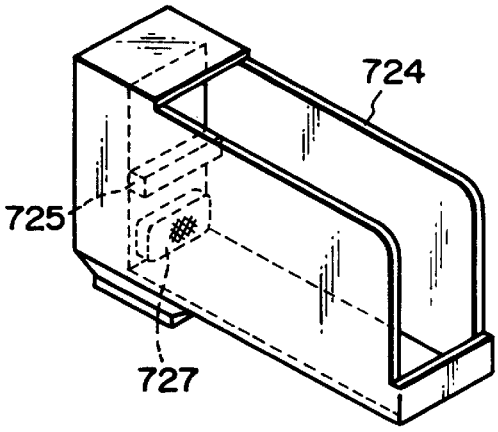
FIG. 20(d)

FIG. 22(a)
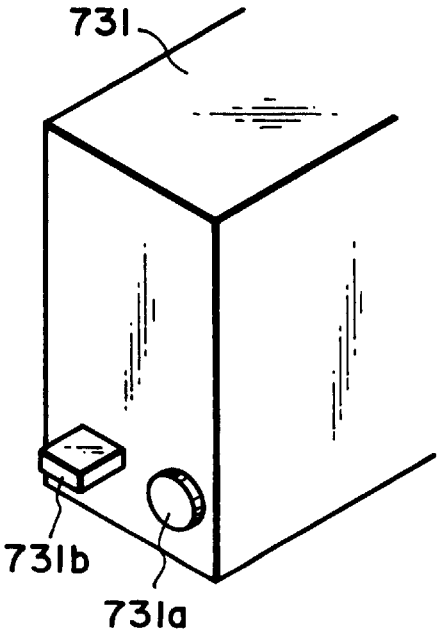
FIG. 22(b)
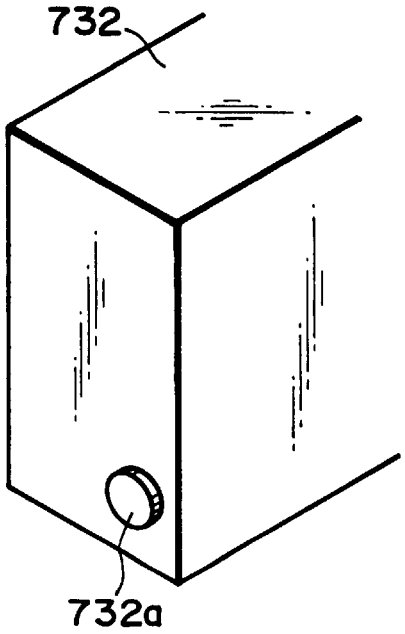
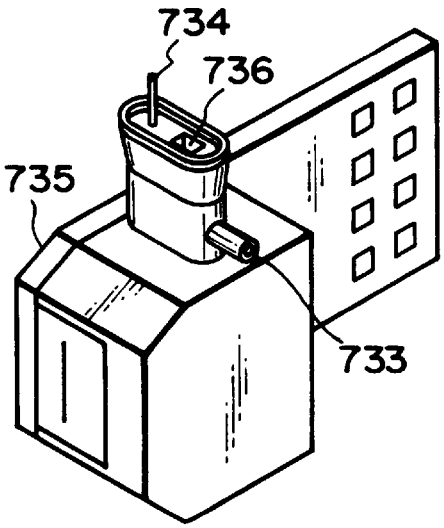
FIG. 22(c)
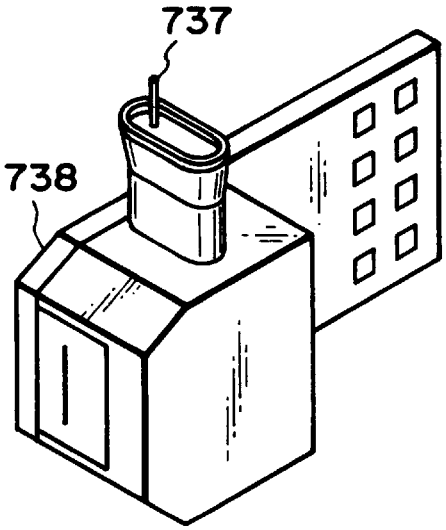
FIG. 22(d)

LIQUID CONTAINER, HEAD CARTRIDGE, LIQUID EJECTING APPARATUS AND LIQUID EJECTION CONTROL METHOD

FIELD OF THE INVENTION AND RELATED ART

The present invention relates to a liquid ejecting head, a liquid ejection head cartridge using the liquid ejecting head, and a liquid ejecting apparatus.

More particularly, the present invention relates to a liquid ejecting head, a head cartridge using the liquid ejecting head, and a liquid ejecting apparatus wherein use is made with a movable member which displaced by generation of a bubble. The present invention is applicable to a printer for printing on a recording material such as paper, thread, fiber, textile, leather, metal, plastic resin material, glass, wood, ceramic or the like; a copying machine; a facsimile machine including a communication system; a word processor or the like including a printer portion; or another industrial recording device comprising various processing devices.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129 and so on, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded to meed the demand, the optimization of the heat generating element such as adjustment of the thickness of the protecting film is investigated. This method is effective in that propagation efficiency of the generated heat to the liquid is improved.

In order to provide high quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 and so on discloses a flow passage structure shown in FIGS. 39, (*a*), (*b*). The flow passage structure or the head manufacturing method disclosed in this publication has been made noting a backward wave (the pressure wave directed away from the ejection outlet, more particularly, toward a liquid chamber 12) generated in accordance with generation of the bubble. The backward wave is known as an energy loss since it is not directed toward the ejecting direction.

FIGS. 39, (*a*) and (*b*) disclose a valve 10 spaced from a generating region of the bubble generated by the heat generating element 2 in a direction away from the ejection outlet 11.

In FIG. 39, (*b*), the valve 4 has an initial position where it is stuck on the ceiling of the flow path 5, and suspends into the flow path 5 upon the generation of the bubble. The loss is said to be suppressed by controlling a part of the backward wave by the valve 4.

On the other hand, in the bubble jet recording method, the heating is repeated with the heat generating element contacted with the ink, and therefore, a burnt material is deposited on the surface of the neat generating element due to burnt deposit of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generated is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, in the head wherein the ejection liquid and the bubble generation liquid are completely separated, the pressure upon the bubble generation is propagated to the ejection liquid through the deformation of the flexible film, and therefore, the pressure is absorbed by the flexible film to a quite high extend. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

It is a principal object of the present invention to provide a liquid container, head cartridge and a liquid ejecting apparatus wherein a liquid container for a single-liquid type can be mounted to a two-liquid type head, so that liquid containers are effectively used.

It is another object of the present invention to provide a liquid container, head cartridge and a liquid ejecting apparatus, wherein a liquid container for a single-liquid type can be mounted to a two-liquid type head, so that liquid containers are effectively used, while liquid container for the two-liquid type is prevented from being mounted to the head to maintain the stability of the ejection performance.

It is a further object of the present invention to provide a liquid ejecting apparatus and a liquid ejection control method, wherein a single-liquid type liquid container and a two-liquid type liquid container can be mounted to a two-liquid type head with high reliability of the head performance.

It is a further object of the present invention to provide a liquid ejecting apparatus wherein even when two-liquid type liquid container is connected to a head single-liquid type through inadvertence, the liquid is not supplied out.

According to an aspect of the present invention, there is provided a liquid ejecting head cartridge comprising: a liquid ejection head, the liquid ejection head including; a first liquid flow path in fluid communication with an ejection outlet; bubble generation region; second liquid flow path distributed adjacent the first liquid flow path; a movable member disposed faced to the bubble generating region and displaceable between a first position and a second position more remote from the bubble generating region than the first position; wherein the first and second liquid flow paths are capable of being supplied with different first 1 and second liquids, respectively; wherein the movable member is displaced from the first position to the second position by pressure produced by the generation of the bubble in the bubble generating portion to direct the pressure toward the ejection outlet, thus ejecting the liquid through the ejection outlet; and the cartridge further comprising: a liquid container device for supplying the liquid to the liquid ejection cartridge, wherein the liquid container device may have a first liquid container accommodating at least the first liquid, or a second liquid container accommodating third liquid which is different from the first liquid and from the second liquid and which is to be supplied commonly to the first and second liquid flow paths, and wherein the first and second liquid containers are mountable the liquid ejecting head.

According to another aspect of the present invention, there is provided a liquid container connectable to a liquid jet head, the liquid ejection head including: a first liquid flow path in fluid communication with an ejection outlet; bubble generation region; second liquid flow path distributed adjacent the first liquid flow path; a movable member disposed faced to the bubble generating region and displaceable between a first position and a second position more remote from the bubble generating region than the first position; and wherein the movable member is displaced from the first position to the second position by pressure produced by the generation of the bubble in the bubble generating portion to direct the pressure toward the ejection outlet, thus ejecting the liquid through the ejection outlet; wherein the container accommodates liquids to be supplied to the first and second liquid flow paths; and wherein the container is connectable to both of the liquid ejection head wherein the first liquid flow path and the second liquid flow path are in fluid communication with each other and a liquid ejection head which is capable of supplying different liquids to the first and second liquid flow paths.

According to a further aspect of the present invention, there is provided a liquid container connectable to a liquid jet head, the liquid ejection head including: a first liquid flow path in fluid communication with an ejection outlet; bubble generation region; second liquid flow path distributed adjacent the first liquid flow path; a movable member disposed faced to the bubble generating region and displaceable between a first position and a second position more remote from the bubble generating region than the first position; wherein the first and second liquid flow paths are capable of being supplied with different first and second liquids, respectively; wherein the movable member is displaced from the first position to the second position by pressure produced by the generation of the bubble in the bubble generating portion to direct the pressure toward the ejection outlet, thus ejecting the liquid through the ejection outlet; wherein the container accommodates at least the first liquid, and the container comprising: a preventing member for preventing connection of the container to a liquid ejection head not for ejecting the first liquid.

According to a further aspect of the present invention, there is provided a liquid ejection apparatus, comprising: a liquid container connectable to a liquid jet head, the liquid ejection head including; a first liquid flow path in fluid communication with an ejection outlet; bubble generation region; second liquid flow path distributed adjacent the first liquid flow path; a movable member disposed faced to the bubble generating region and displaceable between a first position and a second position more remote from the bubble generating region than the first position; wherein the first and second liquid flow paths are capable of being supplied with different first and second liquids, respectively; wherein the movable member is displaced from the first position to the second position by pressure produced by the generation of the bubble in the bubble generating portion to direct the pressure toward the ejection outlet, thus ejecting the liquid through the ejection outlet; wherein the container accommodates the first and second liquids; the container comprising: a first liquid supply port for supply the first liquid; a second liquid supply port for supplying the second liquid; wherein the first and second liquid supply ports have different configurations.

According to a further aspect of the present invention, there is provided a liquid ejection apparatus, comprising: a liquid ejecting head cartridge comprising a liquid ejection head and a liquid container device: the liquid ejection head including; a first liquid flow path in fluid communication with an ejection outlet; bubble generation region; second liquid flow path distributed adjacent the first liquid flow path; a movable member disposed faced to the bubble generating region and displaceable between a first position and a second position more remote from the bubble generating region than the first position; wherein the first and second liquid flow paths are capable of being supplied with different first and second liquids, respectively; wherein the movable member is displaced from the first position to the second position by pressure produced by the generation of the bubble in the bubble generating portion to direct the pressure toward the ejection outlet, thus ejecting the liquid through the ejection outlet; wherein the liquid container device for supplying the liquid to the liquid ejection cartridge, wherein the liquid container device may have a first liquid container accommodating at least the first liquid, or a second liquid container accommodating third liquid which is different from the first liquid and from the second liquid and which is to be supplied commonly to the first and second liquid flow paths, and wherein the first and second liquid containers are mountable the liquid ejecting head; the apparatus further comprising: carrying means for carrying the head cartridge; wherein the first liquid container is provided with a plurality of electrode pads, and the second liquid container is provided with a plurality of electrode pads, and the carrying means is provided with electrode pins connectable with the electrode pads of the first and second liquid containers, wherein liquid container can be discriminated on the basis of state of connections of the pins and pads.

According to a further aspect of the present invention, there is provided a liquid ejection control method for a liquid ejection head; the liquid ejection head including; a first liquid flow path in fluid communication with an ejection outlet; bubble generation region; second liquid flow path distributed adjacent the first liquid flow path; a movable member disposed faced to the bubble generating region and displaceable between a first position and a second position more remote from the bubble generating region than the first position; wherein the first and second liquid flow paths are capable of being supplied with different first and second liquids, respectively; wherein the movable member is displaced from the first position to the second position by pressure produced by the generation of the bubble in the bubble generating portion to direct the pressure toward the ejection outlet, thus ejecting the liquid through the ejection outlet; wherein the head is connectable to both of a first liquid container accommodating at least the first liquid, and a second liquid container accommodating third liquid which is different from the first liquid and from the second liquid and which is to be supplied commonly to the first and second liquid flow paths, and wherein the first and second liquid containers are mountable the liquid ejecting head; the control method comprising the step of providing different bubble generating region in the liquid ejecting head depending on whether the first liquid container or second liquid container is mounted.

According to a further aspect of the present invention, there is provided a liquid ejection apparatus, comprising: a liquid ejecting head cartridge comprising a liquid ejection head and a liquid container device; the liquid ejection head including; a first liquid flow path in fluid communication with an ejection outlet; bubble generation region; a second liquid flow path distributed adjacent the first liquid flow path; a movable member disposed faced to the bubble generating region and displaceable between a first position and a second position more remote from the bubble generating region than the first position; and wherein the movable member is displaced from the first position to the second position by pressure produced by the generation of the bubble in the bubble generating portion to direct the pressure toward the ejection outlet, thus ejecting the liquid through the ejection outlet; the apparatus further comprising: mounting means for mounting the liquid ejecting head and the liquid container; a control valve for controlling supply of the liquid to the liquid ejecting head; a control portion for controlling the control valve; wherein the liquid container is provided with a plurality of electrode pads, and the carrying means is provided with electrode pins connectable with the electrode pads of the liquid containers, wherein the control valve is opened to permit supply of the liquid only when a predetermined connection state between the pins and pads are established.

In addition, the two-liquid type container is not erroneously mounted to a one liquid type head. According to the present invention, a liquid container for a single-liquid type can be mounted to a head, and therefore, the utility is enhanced by effectively using the liquid container, and the cost can be reduced.

The liquid ejecting operation or refreshing operation is carried out in accordance with the property of the liquid supplied from the correct liquid container, identifying the kind of the liquid container mounted to the two-liquid type head, so that high quality images can be printed, and the reliability is improved.

According to an aspect of the present invention wherein the refilling property is improved, the responsivity, stabilized growth of the bubble, and the stabilization of the droplet are accomplished under the condition of the continuous ejection, so that high speed recording and high image quality recording are accomplished by the high speed liquid ejection.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 19(*a*)–(*d*) show another modified example of the first embodiment of the present invention.

FIGS. 20(*a*)–(*d*) show a further modified example of the first embodiment of the present invention.

FIGS. 22(*a*)–(*d*) show a further modified example of the first embodiment of the present invention.

DESCRIPTION OF THE PREFERRED EMBODIMENT

Before the embodiment of the present invention is described, the liquid ejection principle in the liquid ejecting head applicable to the present invention, with the following first to sixth examples.

EXAMPLE 1

Figure 1A:
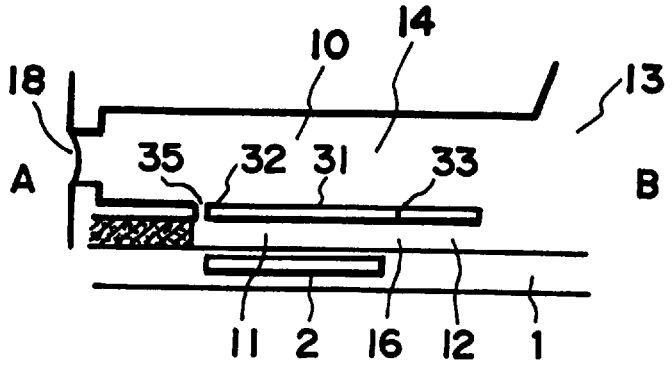
FIGS. 1(*a*)–(*d*) are schematic sectional views of an example of a liquid ejecting head applicable to the present invention.
Figure 1B:
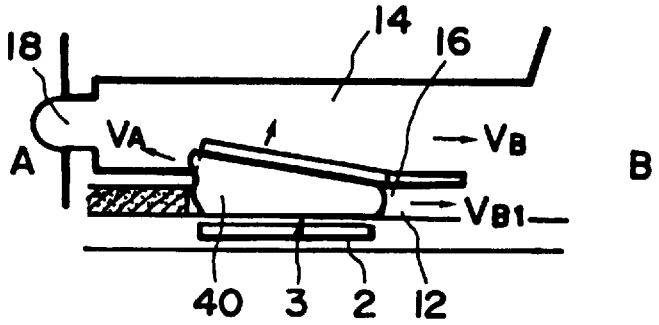
Figure 1C:
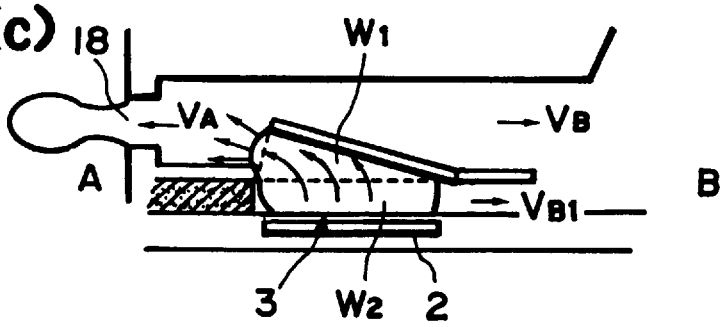
Figure 1D:
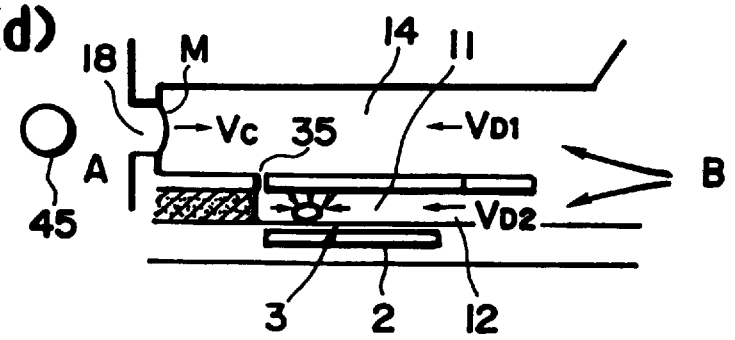
Figure 2:
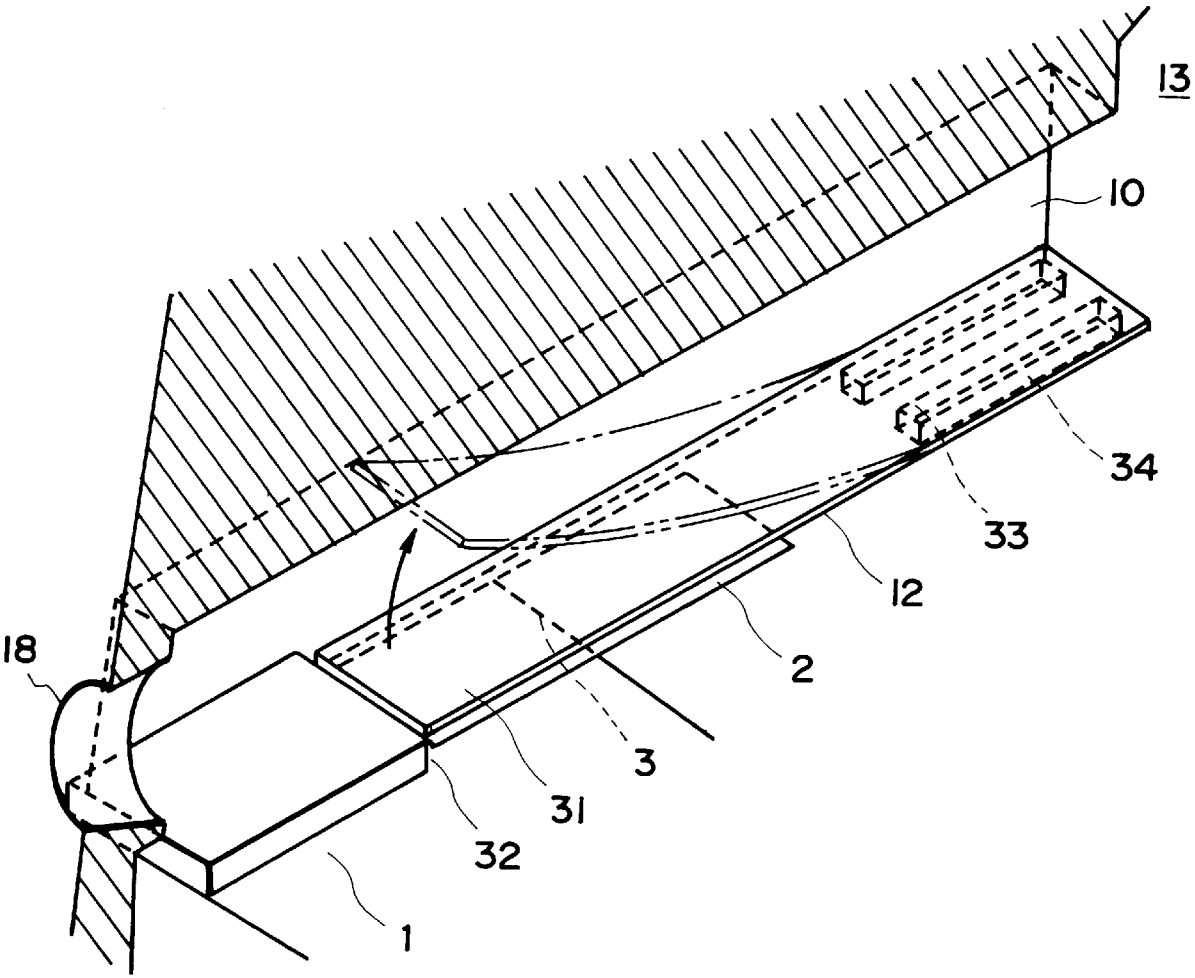
FIG. 2 is a partly broken perspective view of a liquid ejecting head applicable to the present invention.

With this example, the description will be made as to an improvement in an ejection force and/or an ejection efficiency by controlling a direction of propagation of pressure resulting from generation of a bubble for ejecting the liquid and controlling a direction of growth of the bubble. FIG. 1 is a schematic sectional view of a liquid ejecting head taken along a liquid flow path this example, and FIG. 2 is a partly broken perspective view of the liquid ejecting head.

The liquid ejecting head of this embodiment comprises a heat generating element 2 (comprising a first heat generating element 2A and a second heat generating element 2B and having a dimension of 40 $\mu$m×105 $\mu$m as a whole in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which are in fluid communication with a plurality of the ejection outlets 18, respectively.

Above the element substrate in the liquid flow path 10, a movable member or plate 31 in the form of a cantilever of an elastic material such as metal is provided faced to the heat generating element 2. One end of the movable member is fixed to a foundation (supporting member) or the like provided by patterning of photosensitivity resin material on the wall of the liquid flow path 10 or the element substrate. By this structure, the movable member is supported, and a fulcrum (fulcrum portion) 33 is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and so that it has a free end (free end portion) 32 in a downstream side of the fulcrum 33. The movable member 31 is faced to the heat generating element 2 with a gap of 15 $\mu$m approx. as if it covers the heat generating element 2. A bubble generation region 11 is constituted between the heat generating element 21 and movable member 31. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that movable member 31 moves or displaces to widely open toward the ejection outlet side about the fulcrum 33, as shown in FIGS. 1, (*b*) and (*c*) or in FIG. 2. By the displacement of the movable member 31 or the state after the displacement, the propagation of the pressure caused by the generation of the bubble 40 and the growth of the bubble 40 per se are directed toward the ejection outlet 18.

Here, one of the fundamental ejection principles according to the present invention will be described.

One of important principles of this example is that movable member disposed faced to the bubble 40 is displaced from the normal first position to the displaced second position on the basis of the pressure of the bubble generation or the bubble 40 per se, and the displacing or displaced movable member 31 is effective to direct the pressure produced by the generation of the bubble 40 and/or the growth of the bubble 40 per se toward the ejection outlet 18 (downstream).

More detailed description will be made with comparison between the conventional liquid flow passage structure not using the movable member and this example.

Figure 3:
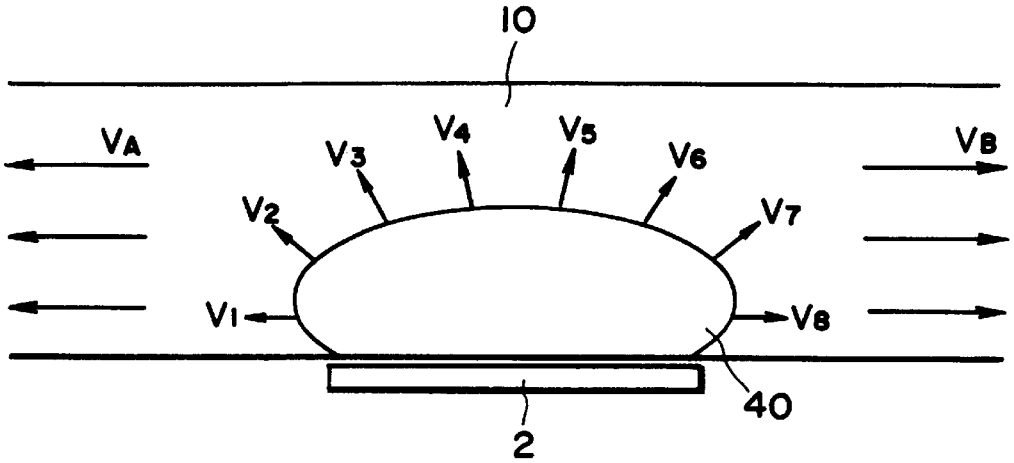
FIG. 3 PRIOR ART
FIG. 3 is a schematic view showing pressure propagation from a bubble in a conventional head.
Figure 4:
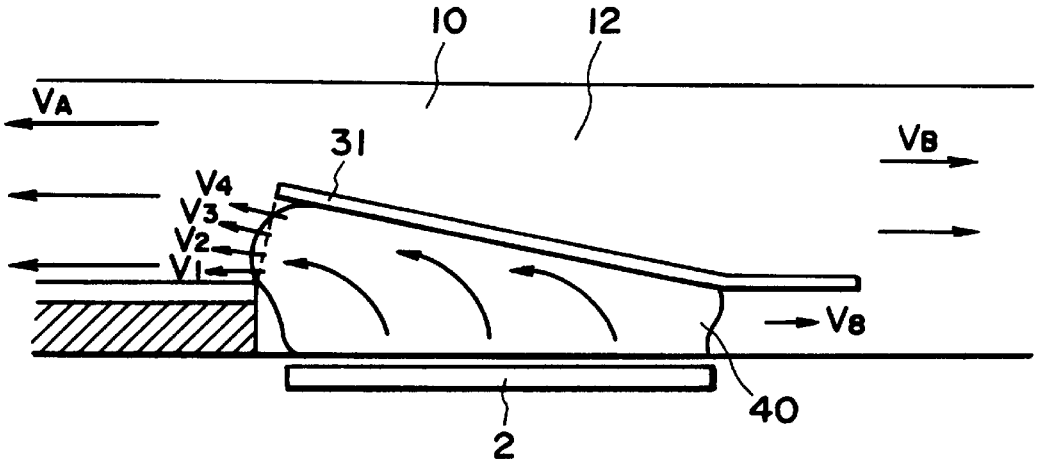
FIG. 4 is a schematic view showing pressure propagation from a bubble in a head applicable to the present invention.

FIG. 3 is a schematic view illustrating pressure propagation from a bubble in a conventional head, and FIG. 4 is a schematic view illustrating a pressure propagation from a bubble in a head applicable to the present invention. Here, the direction of propagation of the pressure toward the ejection outlet is indicated by $V_A$, and the direction of propagation of the pressure toward the upstream is indicated by $V_B$.

In a conventional head as shown in FIG. 3, there is not any structural element effective to regulate the direction of the propagation of the pressure produced by the bubble 40 generation. Therefore, the direction of the pressure propagation of the is normal to the surface of the bubble 40 as indicated by V1–V8, and therefore, is widely directed in the passage. Among these directions, those of the pressure propagation from substantially the half portion of the bubble closer to the ejection outlet (V1–V4), have the pressure components in the $V_A$ direction which is most effective for the liquid ejection. This portion is important since it is directly contributable to the liquid ejection efficiency, the liquid ejection pressure and the ejection speed. Furthermore, the component V1 is closest to the direction of $V_A$ which is the ejection direction, and therefore, the component is most effective, and the V4 has a relatively small component in the direction $V_A$.

On the other hand, in the case of the present invention, shown in FIG. 4, the movable member 31 is effective to direct, to the downstream (ejection outlet side), the pressure propagation directions V1–V4 of the bubble which otherwise are toward various directions. Thus, the pressure propagations of bubble 40 are concentrated so that pressure of the bubble 40 is directly and efficiently contributable to the ejection. The growth direction per se of the bubble is directed downstream similarly to the pressure propagation directions V1–V4, and the bubble grows more in the downstream side than in the upstream side. Thus, the growth direction per se of the bubble is controlled by the movable member, and the pressure propagation direction from the bubble is controlled thereby, so that ejection efficiency, ejection force and ejection speed or the like are fundamentally improved.

Referring back to FIG. 1, the ejecting operation of the liquid ejecting head in this example will be described.

FIG. 1, (*a*) shows a state before the energy such as electric energy is applied to the heat generating element 2, and therefore, no heat has yet been generated.

It should be noted that movable member 31 is so positioned as to be faced at least to the downstream portion of the bubble generated by the heat generation of the heat generating element 2. In other words, in order that downstream portion of the bubble acts on the movable member, the liquid flow passage structure is such that movable member 31 extends at least to the position downstream (downstream of a line passing through the center 3 of the area of the heat generating element and perpendicular to the length of the flow path) of the center 3 of the area of the heat generating element.

FIG. 1, (*b*) shows a state wherein the heat generation of heat generating element 2 occurs by the application of the electric energy to the heat generating element 2, and a part of the liquid filled in the bubble generation region 11 is heated by the thus generated heat so that bubble 40 is generated as a result of film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 1, (*c*) shows a state in which the bubble 40 has further grown by the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 1, (*d*) shows the bubble 40 contracting and extinguishing by the decrease of the internal pressure of the bubble after the film boiling.

The movable member 31 having been displaced to the second position returns to the initial position (first position) of FIG. 2, (*a*) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_c$ so as to compensate for the volume reduction of the bubble in the bubble generation region 11 and to compensate for the volume of the ejected liquid.

In the foregoing the description has been made as to the operation of the movable member caused by the generation of the bubble and the ejecting operation for the liquid, and now the description will be made as to refilling of the liquid in the liquid ejecting head of this example.

The liquid supply mechanism will be further described, referring to FIG. 1. When the bubble 40 enters the bubble collapsing process after the maximum volume thereof (FIG. 1, (*c*)), a volume of the liquid enough to compensate for the collapsing bubbling volume flows into the bubble generation region from the ejection outlet 18 side of the first liquid flow path 14 and from the bubble generation region of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid).

Therefore, when the flow resistance at the ejection outlet side is small, a large amount of the liquid flows into the bubble collapse position from the ejection outlet side, with the result that meniscus retraction is large. With the reduction of the flow resistance in the ejection outlet for the purpose of increasing the ejection efficiency, the meniscus retraction increases upon the collapse of bubble with the result of longer refilling time period, thus making high speed printing difficult.

According to this example, because of the provision of the movable member 31, the meniscus retraction stops at the time when the movable member returns to the initial position upon the collapse of bubble, and thereafter, the supply of the liquid to fill a volume W2 is accomplished by the flow through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream of the second liquid flow path along the surface of the heat generating element side of the movable member 31 using the pressure upon the collapse of bubble, and therefore, more speedy refilling action is accomplished.

When the high speed refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that vibration of the meniscus is reduced. Thus, according to this example, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The example provides the following effective function, too. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the inertia force.

In this example, these actions to the upstream side are suppressed by the movable member 31, so that refilling performance is further improved.

Additional description will be made as to the structure and effect in this example.

With this structure, the supply of the liquid to the surface of the heat generating element 2 and the bubble generation region 11 occurs along the surface of the movable member 31 at the position closer to the bubble generation region 11. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not extinguished are removed without difficulty, and in addition, the heat accumulation in the liquid is not too much. Therefore, more stabilized generation of the bubble can be repeated at high speed. In this embodiment, the liquid supply passage 12 has a substantially flat internal wall, but this is not limiting, and the liquid supply passage is satisfactory if it has an internal wall with such a configuration smoothly extended from the surface of the heat generating element that stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2. Then, the flow resistance for the liquid between the bubble generation region 11 and the region of the first liquid flow path 14 close to the ejection outlet is increased by the restoration of the movable member to the first position, so that flow of the liquid to the bubble generation region 11 can be suppressed. However, according to the head structure of this example, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 5:
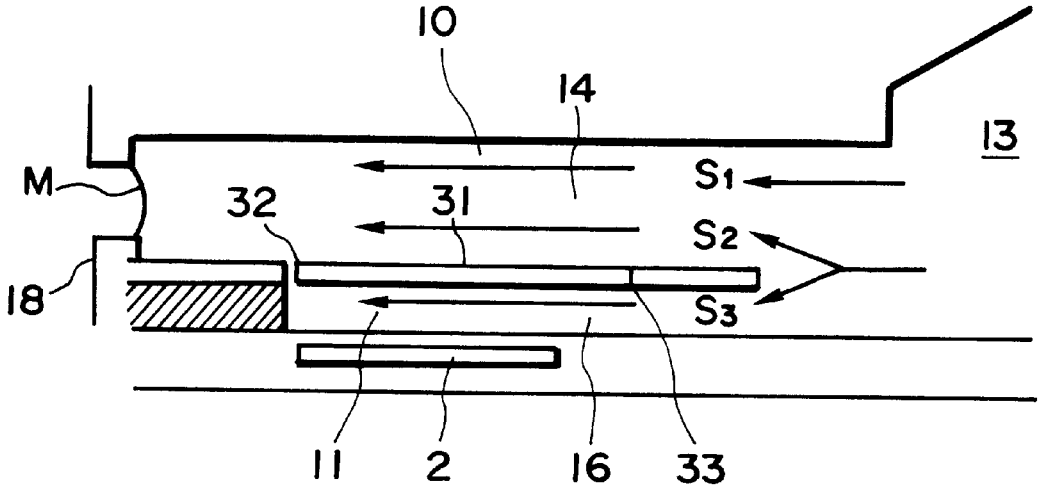
FIG. 5 is a schematic view illustrating flow of the liquid in a head applicable to the present invention.

FIG. 5 is a schematic view illustrating flow of the liquid in this example.

The positions of the free end 32 and the fulcrum 33 of the movable member 31 are such that free end 32 is relatively downstream of the fulcrum 33, as shown in FIG. 5 example. With this structure, the function and effect of guiding the pressure propagation direction and the direction of the growth of the bubble to the ejection outlet 18 side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 5, returns to the ejection outlet 18 by capillary force or when the liquid supply is effected to compensate for the collapse of bubble, the positions of the free end and the fulcrum 33 are such that flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble 40 which are greatly contributable to the ejection of the liquid at the downstream side of the area center position 3 of the heat generating element 2, and it guides the force to the ejection outlet side, thus fundamentally improving the ejection efficiency or the ejection force.

Further advantageous effects are provided using the upstream side of the bubble 40, as described hereinbefore.

In the structure of this example, the instantaneous mechanical displacement of the free end of the movable member 31 is considered as contributing to the ejection of the liquid.

EXAMPLE 2

Figure 6:
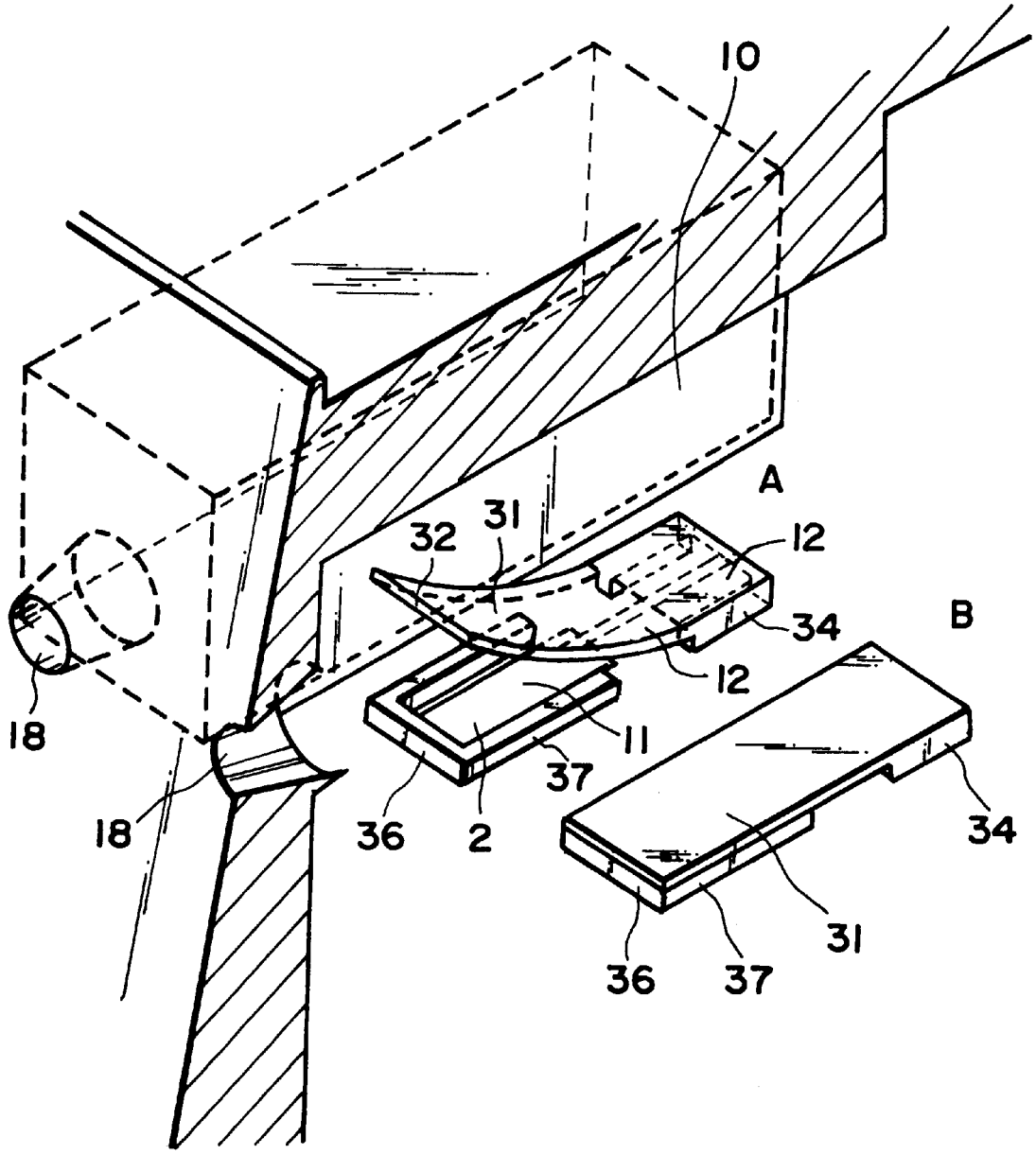
FIG. 6 is a partly broken perspective view of a liquid ejecting head according to a second embodiment applicable to the present invention.

FIG. 6 is a partly broken perspective view of a liquid ejecting head according to a second embodiment applicable to the present invention.

In FIG. 6, shows a state in which the movable member is displaced (bubble is not shown), and B shows a state in which the movable member is in its initial position (first position). In the latter state, the bubble generation region 11 is substantially sealed from the ejection outlet 18 (between A and B, there is a flow passage wall to isolate the paths).

A foundation 34 is provided at each side, and between them, a liquid supply passage 12 is constituted. With this structure, the liquid can be supplied along a surface of the movable member 31 faced to the heat generating element side and from the liquid supply passage having a surface substantially flush with the surface of the heat generating element 2 or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that ejection outlet 18 side of the bubble generation region 11 is substantially sealed. Thus, the pressure produced by the bubble at the time of the bubble generation and particularly the pressure downstream of the bubble, can be concentrated on the free end side of the movable member, without releasing the pressure.

At the time of the collapse of bubble, the movable member 31 returns to the first position, the ejection outlet side of the bubble generation region 31 is substantially sealed, and therefore, the meniscus retraction is suppressed, and the liquid supply to the heat generating element is carried out with the advantages described herein before. As regards the refilling, the same advantageous effects can be provided as in the foregoing embodiment.

Figure 7:
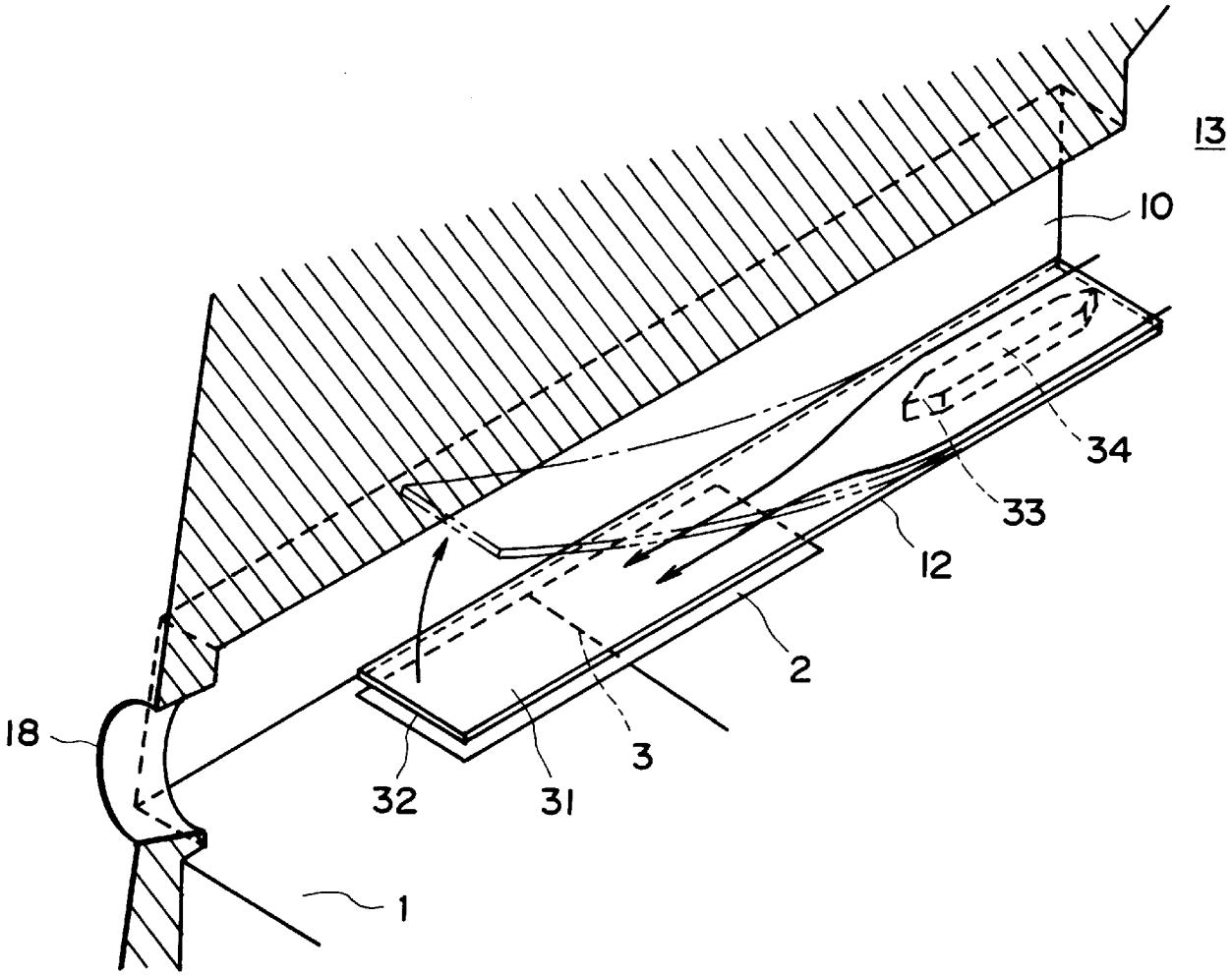
FIG. 7 is a partly broken perspective view of a liquid ejecting head according to a third embodiment of the present invention.

In this example, the foundation 34 for supporting and fixing the movable member 31 is provided at an upstream position away from the heat generating element 2, as shown in FIG. 3 and FIG. 7, and the foundation 34 has a width smaller than the liquid flow path 10 to supply the liquid to the liquid supply passage 12. The configuration of the foundation 34 is not limited to this structure, but may be anyone if smooth refilling is accomplished.

In this embodiment, the clearance between the movable member 31 and the clearance is 15 $\mu$m approx., but the distance may be changed as long as the pressure produced by the bubble generation is sufficiently propagated to the movable member.

EXAMPLE 3

FIG. 7 is a partly broken perspective view of a liquid ejecting head according to a third embodiment of the present invention.

FIG. 7 shows positional relation among the bubble generating region, bubble generation there and the movable member in one liquid flow path.

In most of the foregoing examples, the pressure of the bubble generated is concentrated toward the free end of the movable member 31, by which the movement of the bubble is concentrated to the ejection side 18, simultaneously with the quick motion of the movable member 31.

In this embodiment, a latitude is given to the generated bubble, and the downstream portion of the bubble (at the ejection outlet 18 side of the bubble) which is directly influential to the droplet ejection, is regulated by the free end side of the movable member 31.

As compared with FIG. 2 (first embodiment), the head of FIG. 7 does not include a projection (hatched portion) as a barrier at a downstream end of the bubble generating region on the element substrate 1 of FIG. 2. In other words, the free end region and the opposite lateral end regions of the movable member 31, is open to the ejection outlet region without substantial sealing of the bubble generating region in this embodiment.

Of the downstream portion of the bubble directly contributable to the liquid droplet ejection, the downstream leading end permits the growth of the bubble, and therefore, the pressure component thereof is effectively used for the ejection. In addition, the pressure directed upwardly at least in the downstream portion (component force of VB in FIG. 3) functions such that free end portion of the movable member is added to the bubble growth at the downstream end portion. Therefore, the ejection efficiency is improved, similarly to the foregoing embodiment. As compared with the foregoing examples, the structure of this embodiment is better in the responsivity of the driving of the heat generating element.

In addition, the structure is simple so that manufacturing is easy.

The fulcrum portion of the movable member 31 in this example, is fixed to one foundation 34 having a width smaller than the surface portion of the movable member 31. Therefore, the liquid supply to the bubble generation region 11 upon the collapse of bubble occurs along both of the lateral sides of the foundation (indicated by an arrow). The foundation may be in another form if the liquid supply performance is assured.

In the case of this example, the existence of the movable member 31 is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the example, both of the lateral sides (or only one lateral side) of the movable member 31 are substantially sealed for the bubble generation region 11. With such a structure, the pressure toward the lateral side of the movable member is also directed to the ejection outlet side end portion, so that ejection efficiency is further improved.

EXAMPLE 4

In this example, the ejection power for the liquid by the mechanical displacement is further enhanced.

Figure 8:
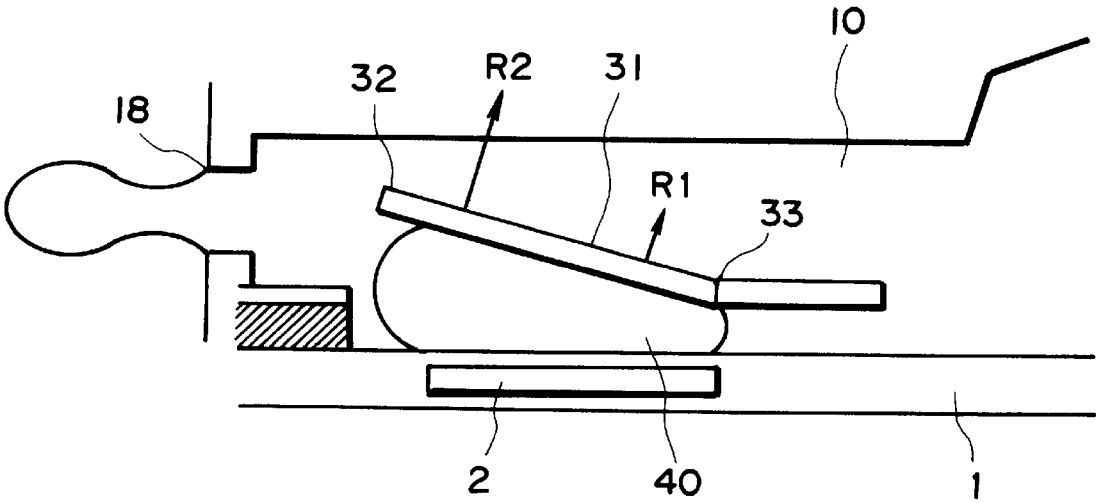
FIG. 8 is a sectional view of a liquid ejecting head according to a fourth embodiment.

FIG. 8 is a cross-sectional view of such a head structure usable with the present invention.

In FIG. 8, the movable member is extended such that position of the free end 32 of the movable member 31 is positioned further downstream of the ejection outlet side end of the heat generating element 2. By this, the displacing speed of the movable member 31 at the free end position 32 can be increased, and therefore, the production of the ejection power by the displacement of the movable member 31 is further improved.

In addition, the free end 32 is closer to the ejection outlet 18 side than in the foregoing embodiment, and therefore, the growth of the bubble 40 can be concentrated toward the stabilized direction, thus assuring the better ejection.

In response to the growth speed of the bubble 40 at the central portion of the pressure of the bubble, the movable member 31 displaces at a displacing speed R1. The free end 32 which is at a position further than this position from the fulcrum 33, displaces at a higher speed R2. Thus, the free end 32 mechanically acts on the liquid at a higher speed to increase the ejection efficiency. The free end configuration is such that, as is the same as in FIG. 7, the edge is vertical to the liquid flow, by which the pressure of the bubble 40 and the mechanical function of the movable member 31 are more efficiently contributable to the ejection.

EXAMPLE 5

Figure 9A:
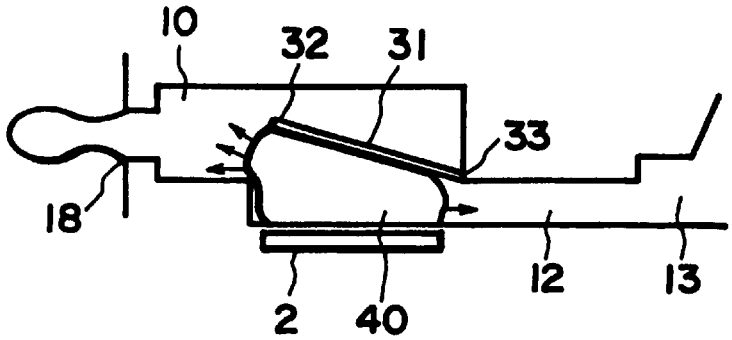
FIGS. 9(*a*)–(*c*) are schematic sectional views of a liquid ejecting head according to a fifth embodiment of the present invention.
Figure 9B:
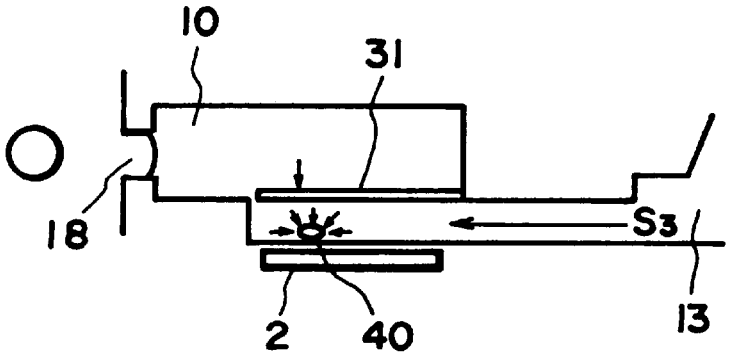
Figure 9C:
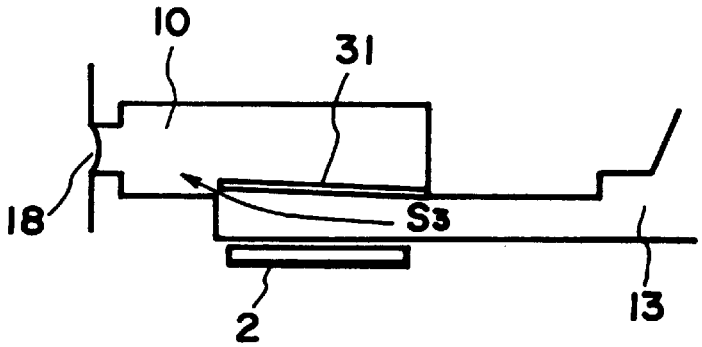

FIG. 9 is a schematic sectional view of a liquid ejecting head of example 5 applicable to the present invention.

As is different from the foregoing embodiment, the region in direct fluid communication with the ejection outlet 18 is not in fluid communication with the liquid chamber, and therefore, the structure is simplified. The liquid is supplied only from the liquid supply passage 12 along the surface of the bubble generation region side of the movable member 31. The free end 32 of the movable member 31, the positional relation of the fulcrum 33 relative to the ejection outlet 18 and the structure of facing to the heat generating element 2 are similar to the above-described embodiment.

According to this example, the advantageous effects in the ejection efficiency, the liquid supply performance and so on described above, are accomplished. Particularly, the retraction of the meniscus is suppressed, and a forced refilling is effected substantially thoroughly using the pressure upon the collapse of bubble.

FIG. 9, (*a*) shows a state in which the bubble generation is caused by the heat generating element 2, and FIG. 9, (*b*) shows the state in which the bubble is going to contract. At this time, the returning of the movable member 31 to the initial position and the liquid supply by $S_3$ are effected.

In FIG. 9, (*c*), the small retraction M of the meniscus upon the returning to the initial position of the movable member, is being compensated for by the refilling by the capillary force in the neighborhood of the ejection outlet 18.

EXAMPLE 6

In this example, the same ejection principle is used, and the liquid wherein the bubble generation is carried out (bubble generation liquid), and the liquid which is mainly ejected (ejection liquid) are separated.

Figure 10:
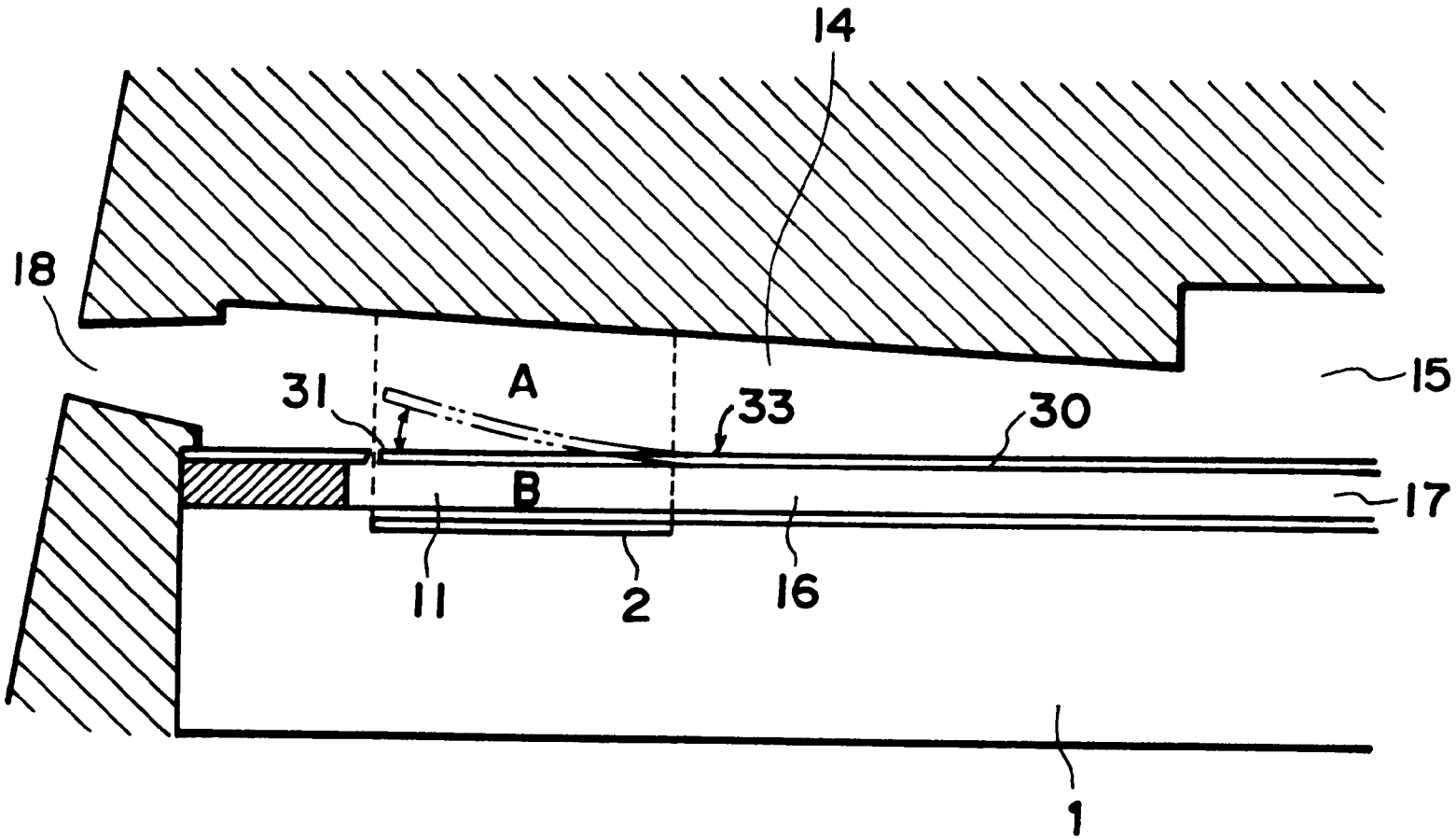
FIG. 10 is a sectional view of a liquid ejecting head (two-path) according to a sixth embodiment of the present invention.

FIG. 10 is a schematic sectional view, in a direction of flow of the liquid, of the liquid ejecting head according to this embodiment.

In the liquid ejecting head, there is provided a second liquid flow path 16 for the bubble generation liquid on an element substrate 1 provided with a heat generating element 2 for applying thermal energy for generating the bubble in the liquid, and there is further provided, on the second liquid flow path 16, a first liquid flow path 14 for the ejection liquid, in direct communication with the ejection outlet 18. The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths. In the case that bubble generation liquid and ejection liquid are the same liquids, the number of the common liquid chambers may be one.

Between the first and second liquid flow paths, there is a separation wall 30 of an elastic material such as metal so that first flow path 14 and the second flow path 16 are separated. In the case that mixing of the bubble generation liquid and the ejection liquid should be minimum, the first liquid flow path 14 and the second liquid flow path 16 are preferably isolated by the partition wall 30. However, when the mixing to a certain extent is permissible, the complete isolation is not inevitable.

Figure 11:
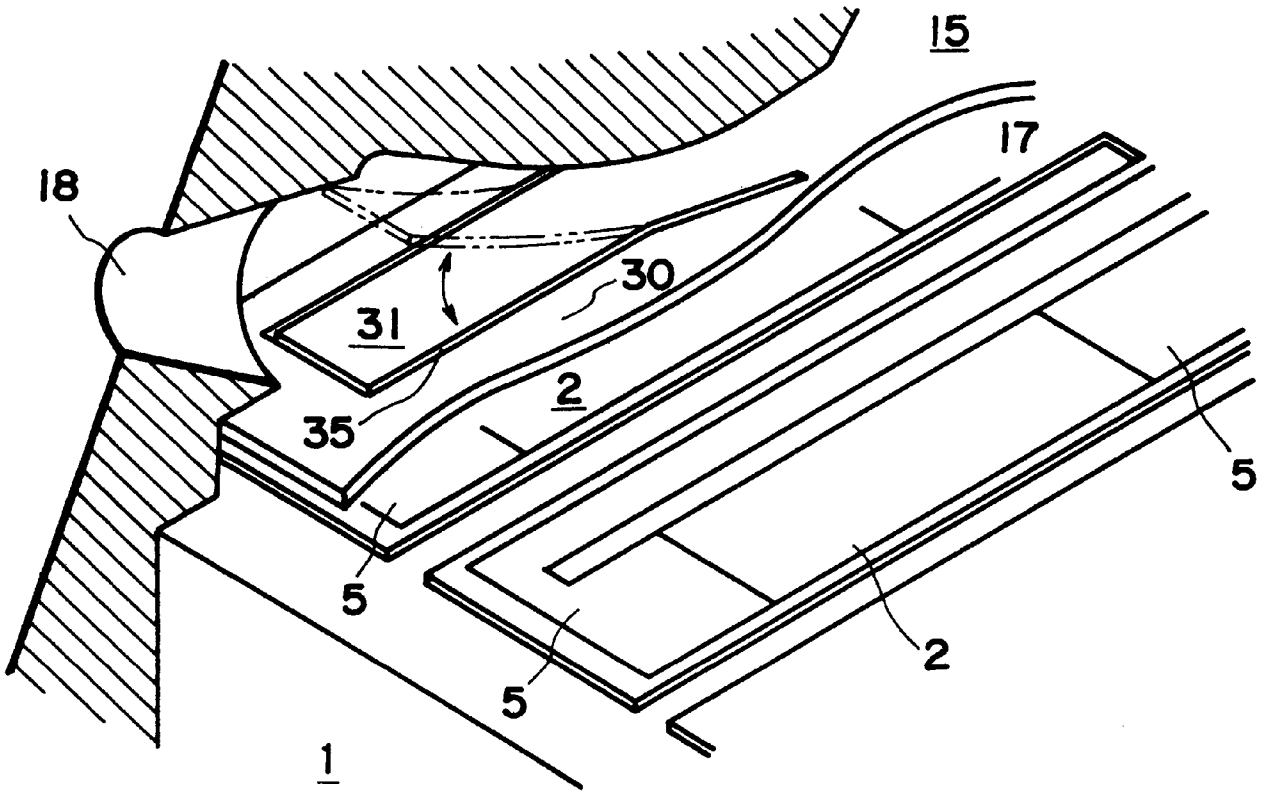
FIG. 11 is a partly broken perspective view of a liquid ejecting head used in the type of FIG. 10.

The movable member 31 is in the form of a cantilever wherein such a portion of separation wall as is in an upward projected space of the surface of the heat generating element 2 (ejection pressure generating region, region A and bubble generating region 11 of the region B in FIG. 18) constitutes a free end by the provision of the slit 35 at the ejection outlet side (downstream with respect to the flow of the liquid), and the common liquid chamber (15, 17) side thereof is a fulcrum or fixed portion 33. This movable member 31 is located faced to the bubble generating region 11 (B), and therefore, it functions to open toward the ejection outlet 18 side of the first liquid flow path upon bubble generation of the bubble generation liquid (in the direction indicated by the arrow, in the Figure). In an example of FIG. 11, too, a partition wall 30 is disposed, with a space for constituting a second liquid flow path 16, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element 2, are the same as in the previous example.

In the previous example, the description has been made as to the relation between the structures of the liquid supply passage 12 and the heat generating element 2. The relation between the second liquid flow path 16 and the heat generating element 2 is the same in this example.

The operation of the liquid ejecting head of this example will be described.

Figure 12A:
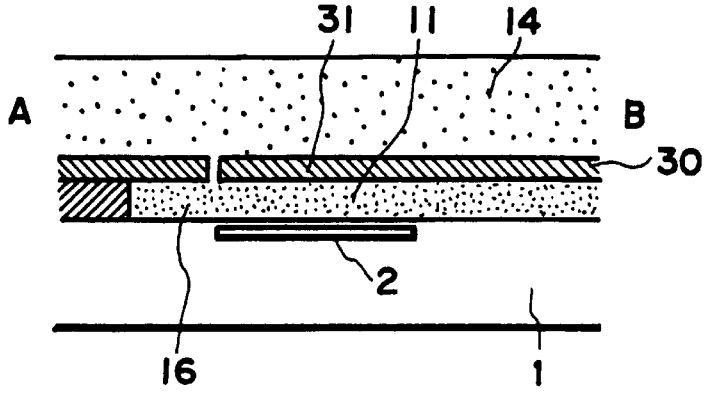
FIGS. 12(*a*)–(*b*) illustrate an operation of a movable member.
Figure 12B:
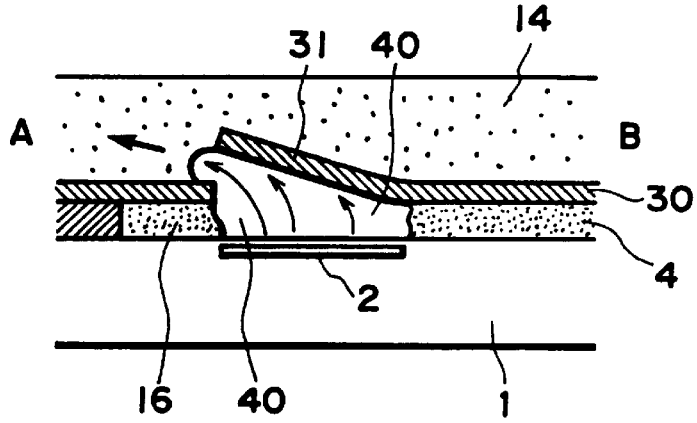

FIG. 12 illustrates an operation of a movable member.

The used ejection liquid in the first liquid flow path 14 and the used bubble generation liquid in the second liquid flow path 16 were the same water base inks. By the heat generated by the heat generating element 2, the bubble generation liquid in the bubble generation region in the second liquid flow path 12 generates a bubble 40, by film boiling phenomenon as described hereinbefore (U.S. Pat. No. 4,723,129).

In this example, the bubble generation pressure is not released in the three directions except for the upstream side in the bubble generation region 11, so that pressure produced by the bubble generation is propagated concentratedly on the movable member 31 side in the ejection pressure generation portion, by which the movable member 31 is displaced from the position indicated in FIG. 12, (*a*) toward the first liquid flow path 14 side as indicated in FIG. 12, (*b*) with the growth of the bubble 40. By the operation of the movable member, the first liquid flow path 14 and the second liquid flow path 16 are in wide fluid communication with each other, and the pressure produced by the generation of the bubble 40 is mainly propagated toward the ejection outlet in the first liquid flow path 14 (direction A). By the propagation of the pressure and the mechanical displacement of the movable member 31, the liquid is ejected through the ejection outlet.

Then, with the contraction of the bubble, the movable member 31 returns to the position indicated in FIG. 12, (*a*), and correspondingly, an amount of the liquid corresponding to the ejection liquid is supplied from the upstream in the first liquid flow path 14. In this embodiment, the direction of the liquid supply is codirectional with the closing of the movable member 31 as in the foregoing embodiments, the refilling of the liquid is not impeded by the movable member 31.

The major functions and effects as regards the propagation of the bubble generation pressure with the displacement of the movable member 31, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path 16 as the bubble generation liquid, an example of the bubble generation liquid a mixture liquid (1–2 cP approx. of ethanol and water 4:6). By doing so, the ejection liquid can be properly ejected.

Additionally, by selecting as the bubble generation liquid a liquid with which the deposition such as burnt deposit does not remain on the surface of the heat generating element even upon the heat application, the bubble generation is stabilized to assure the proper ejections. The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path 14 as the ejection liquid, and a liquid which is not easily altered in the property by the heat and with which the bubble generation is in good order, is supplied in the second liquid flow path 16. By doing so, the liquid can be ejected without thermal damage and with high ejection efficiency and with high ejection pressure.

The description will be made as to a liquid ejection recording device carrying a liquid ejecting head of the foregoing Examples 1–6.

Figure 13:
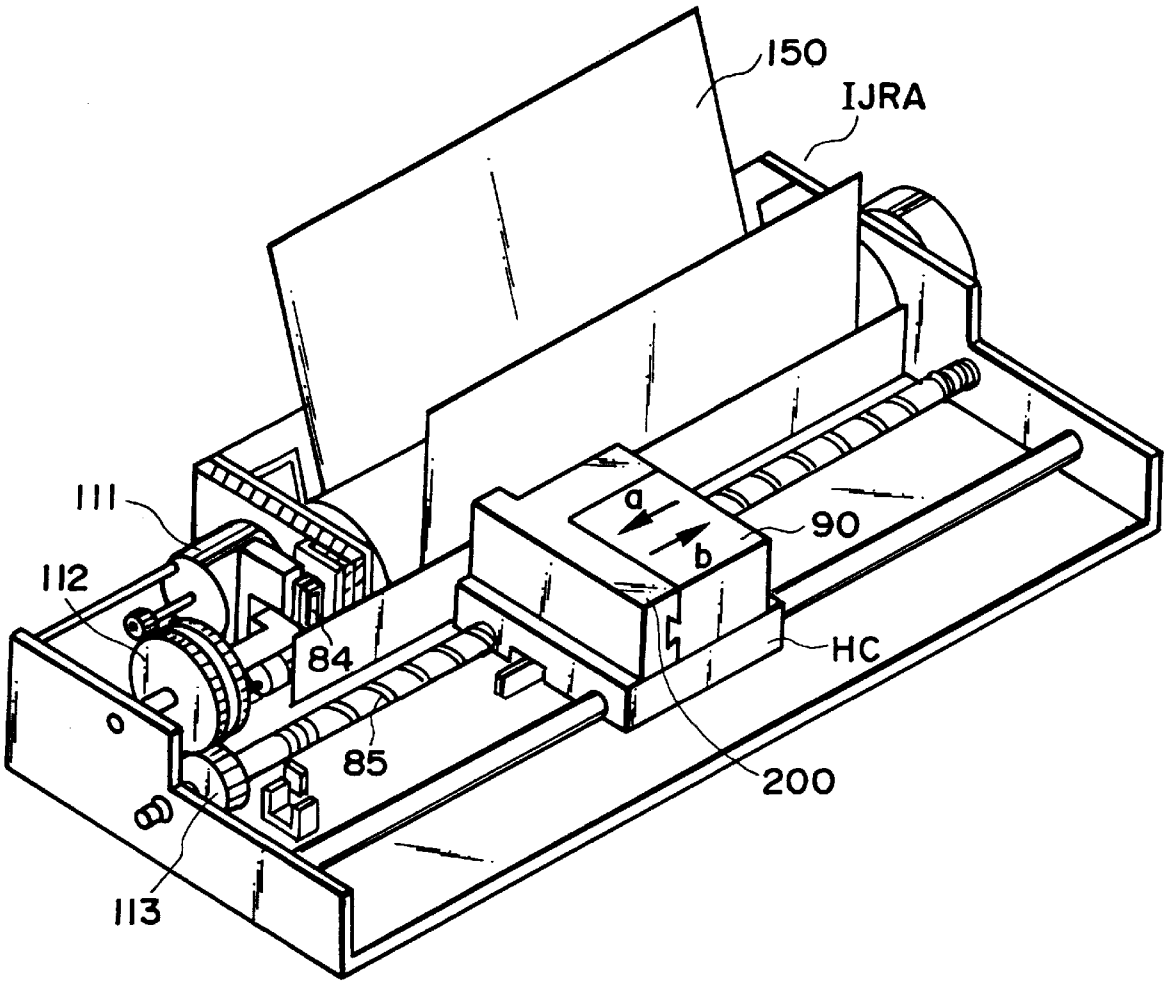
FIG. 13 is a schematic illustration of a liquid ejecting apparatus.

FIG. 13 is a schematic illustration of a liquid ejecting apparatus.

In this example, the ejection liquid is ink. The apparatus is an ink ejection recording apparatus. the liquid ejecting device comprises a carriage HC to which the head cartridge comprising a liquid container portion 90 and liquid ejecting head portion 201 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head 201 in response to the signal.

Figure 14:
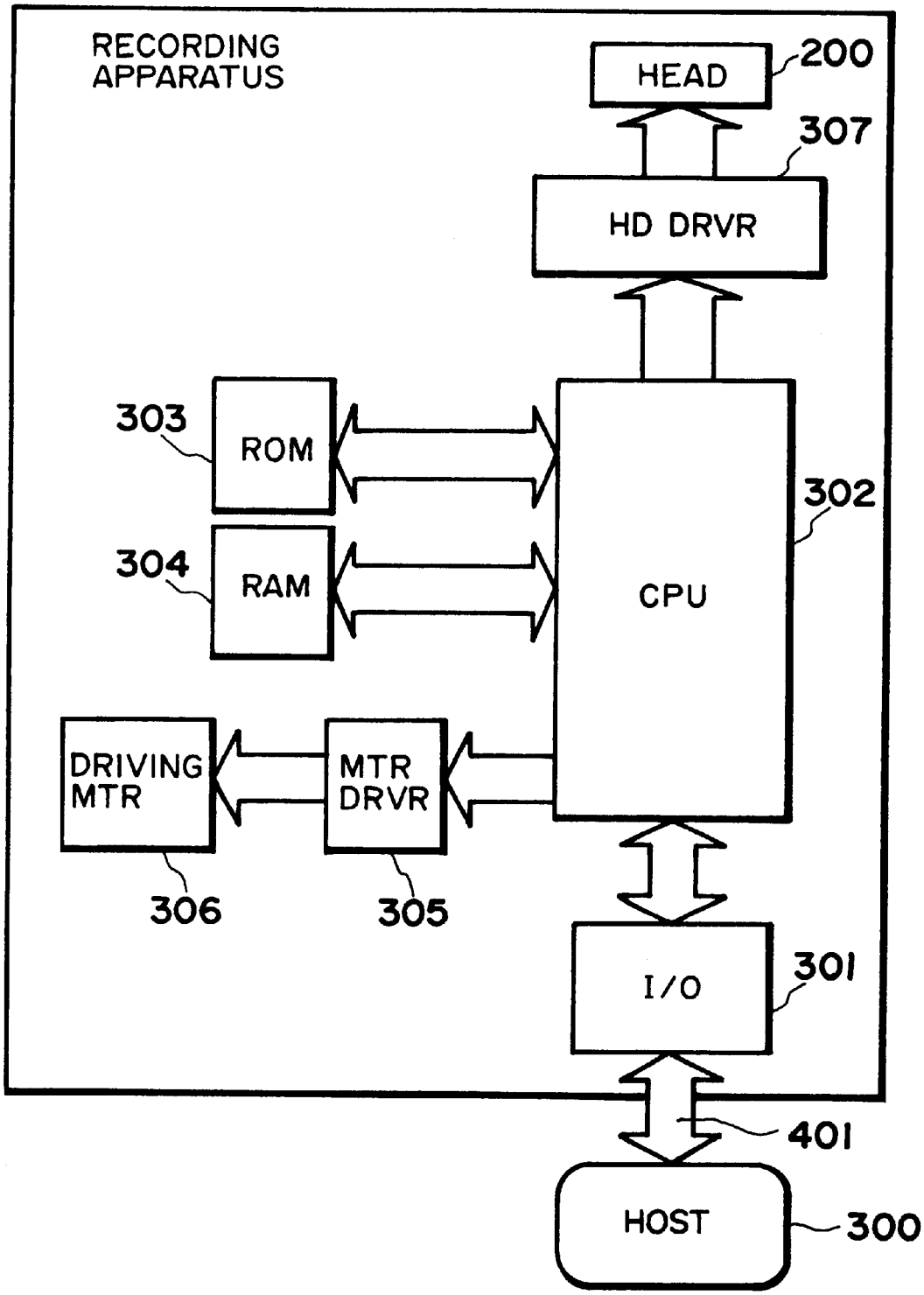
FIG. 14 is a block Figure of an apparatus.

The liquid ejecting apparatus of this example comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material. FIG. 14 is a block diagram of the entirety of the device for carrying out ink ejection recording using the liquid ejecting head and the liquid ejecting method applicable to the present invention.

The recording apparatus receives printing data in the form of a control signal from a host computer 300. The printing data is temporarily stored in an input interface 301 of the printing apparatus, and at the same time, is converted into processible data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in a ROMs 303.

Further, in order to record the image data onto an appropriate spot on a recording sheet, the CPU302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming a image.

As for recording material, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording material such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

In the foregoing, the description will be made as to the liquid ejection recording head and a liquid ejection recording device using the liquid ejecting head applicable to the present invention.

Now, the description will be made as to four embodiments of the present invention in conjunction with the accompanying drawing.

With the head using the above-described ejection principle, the bubble generating region is separated from the ejection outlet region by the movable member, and therefore, the two-liquid flow passage structure can be adopted which includes a first liquid flow path in fluid communication with the ejection outlet and a second liquid flow path including a bubble generating region. For example, the two-liquid flow passage structure described with Example 6 can be used. Using such a liquid ejecting head having the two-liquid flow passage structure, it is possible to constitute a two-liquid type head wherein the ejection liquid is supplied to the first liquid flow path, and bubble generation liquid which is different from the ejection liquid, is supplied to the second liquid flow path, and a single-liquid type wherein the liquid is common to the first and second liquid flow paths (it is ejection liquid, but is different from the liquid in the two-liquid type head. In the case of the two-liquid type head, the use is made with a liquid container accommodating the bubble generation liquid and the ejection liquid separately, and in the case of the single-liquid type head, a container accommodating the common liquids (ejection liquid) therein is used. In the Examples 1–5, the ones capable of separating the first and second liquid paths, can be used for the single-liquid type head and the two-liquid type. In the case of the liquid ejecting head capable of constituting the two type heads, namely, the single-liquid type and the two-liquid type, the liquid container for the single-liquid type may be mounted to the two-liquid type head, or the liquid container for the two-liquid type may be mounted to the single-liquid type head. When a single-liquid type container is mounted to the two-liquid type head, the recording property intended by the two-liquid type head is not provided, but the recording property equivalent to or higher than the recording property of a conventional bubble jet printer. However, when the two-liquid type container is mounted to the single-liquid type head, the following problem arises.

As described hereinbefore, in the case of the two-liquid type head, a highly viscous ejection liquid may be used. If such a two-liquid type container is mounted to the single-liquid type head, the high viscosity ejection liquid is used as a bubble generation liquid, with the result of burnt deposit on the heat generating element, and therefore, the ejection is not stabilized or it fails.

According to an embodiment of the present invention, there is provided a mounting structure between liquid ejecting head and a liquid container wherein the single-liquid type container can be mounted to the two-liquid type head, but the two-liquid type container is not mounted to the single-liquid type head.

Embodiment 1

Figure 15:
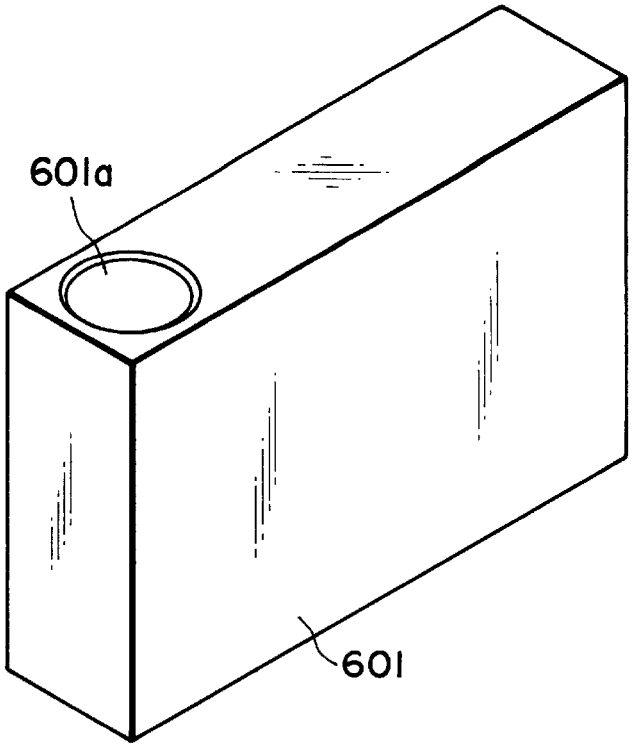
FIG. 15 is a perspective view of a single-liquid type use according to an embodiment of the present invention.
Figure 16:
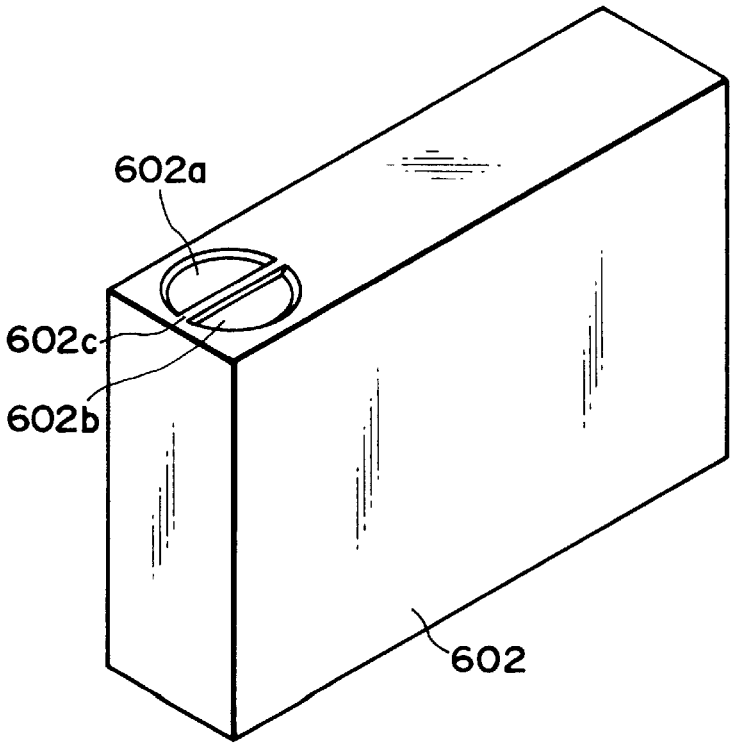
FIG. 16 is a perspective view of a 2-liquid type use according to an embodiment of the present invention.
Figure 17A:
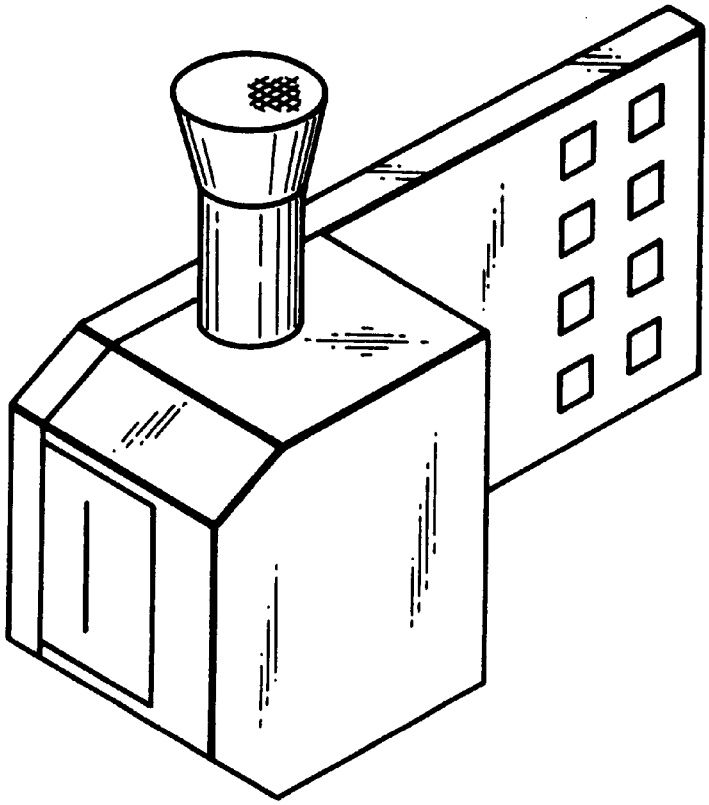
FIG. 17 is an illustration of a configuration at an end of a supply port for the liquid for a liquid ejecting head according to an embodiment of the present invention, wherein (a) is a perspective view, (b) is a perspective view of a filter portion at an end of a supply port of a single-liquid type liquid ejecting head according to an embodiment of the present invention, and (c) is a perspective view of a filter portion forming an end portion of the supply port of a single-liquid type liquid ejecting head according to an embodiment of the present invention.
Figure 17B:
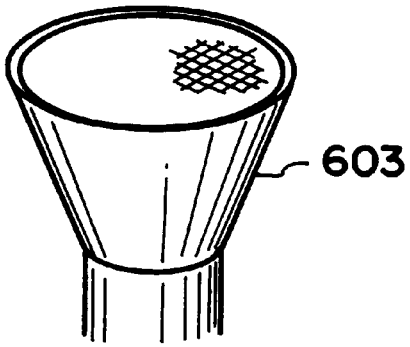
Figure 17C:
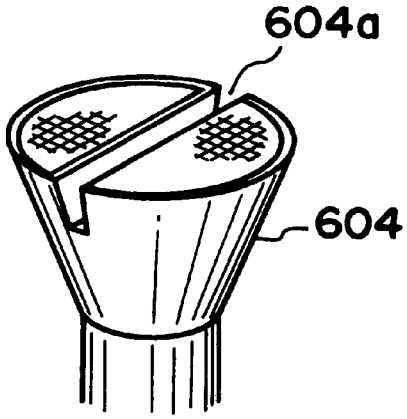
Figure 18A:
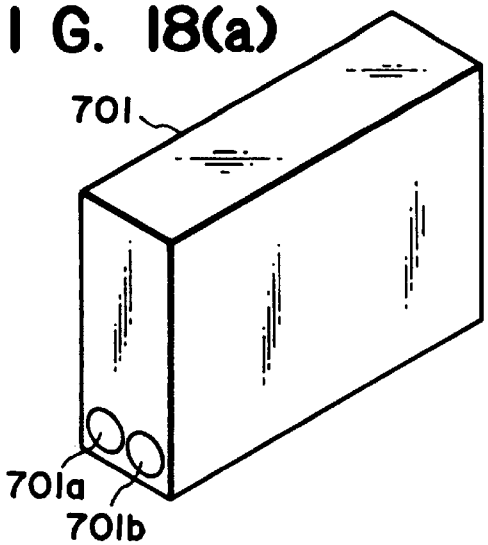
FIGS. 18, (*a*) to (*f*) shows a modified example of the first embodiment of the present invention.
Figure 18B:
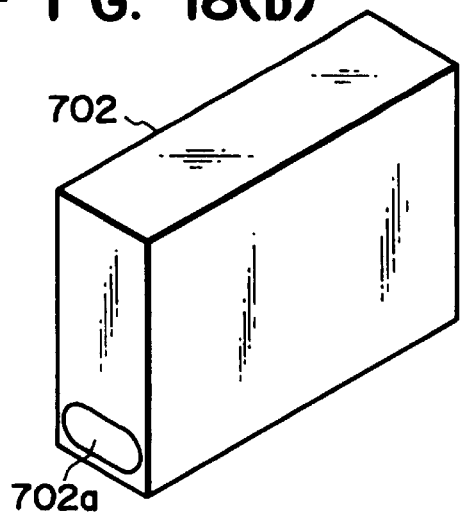
Figure 18C:
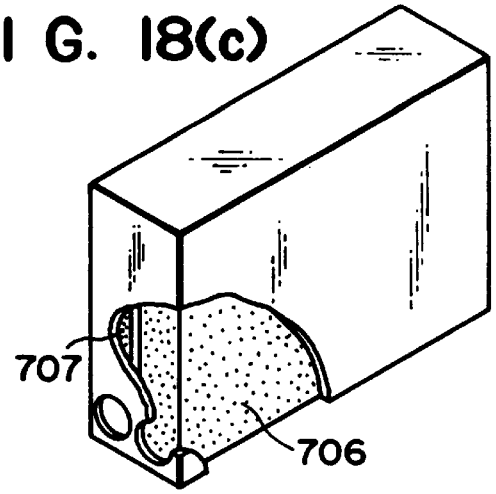
Figure 18D:
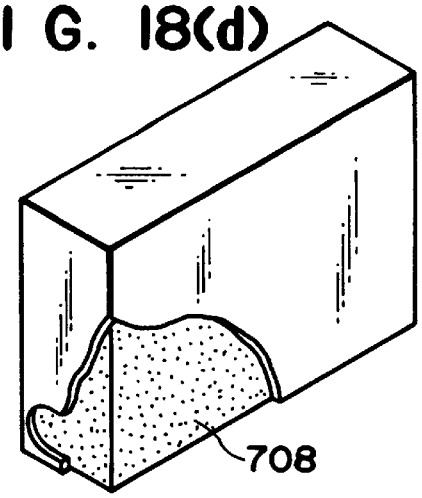
Figure 18E:
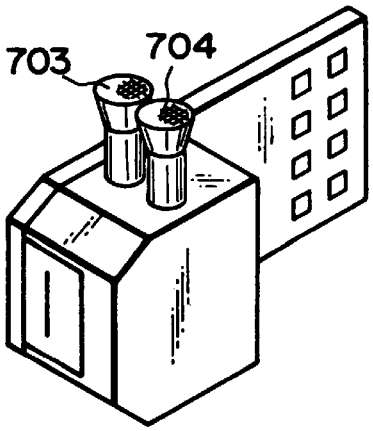
Figure 18F:
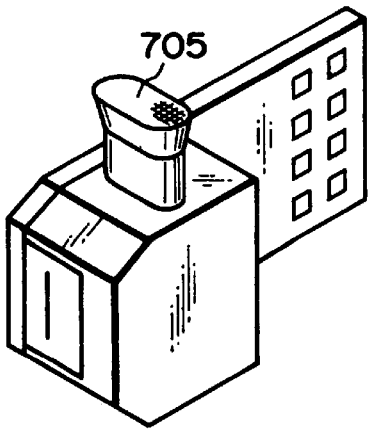

FIG. 15 is a perspective view of the single liquid type liquid container in the first embodiment of the present invention. FIG. 16 in a perspective view of the two liquid type liquid container in the first embodiment of the present invention. FIG. 17 is a perspective view of a liquid ejection head in accordance with the present invention, and the adjacencies thereof, FIG. 17, (*a*) being a perspective view of the liquid ejection head, FIG. 17, (*b*) being a perspective view of the filter portion which is located at the opening through which liquid is supplied to the single liquid type liquid ejection head in the first embodiment of the present invention, and FIG. 17, (*c*) being a perspective view of the filter portion which is located at the opening through which liquid is supplied to the two ink type liquid ejection head in the first embodiment of the present invention.

A single liquid type container 601 illustrated in FIG. 15 contains common liquid (ejection liquid), and is provided with a liquid supply port 601*a*, through which the liquid (ejection liquid) held within the container 601 is supplied to a liquid ejection head.

A two liquid type liquid container 602 illustrated in FIG. 16 separately contains ejection liquid and bubble generation liquid, and is provided with semicircular liquid supply ports 602*a* and 602*b*, through which the ejection liquid and bubble generation liquid held in the container 602 are supplied to a liquid ejection head, respectively. The radiuses of the semicircular liquid supply ports 602*a* and 602*b* are the same as that of the circular liquid supply port 601*a*, but the supply ports 602*a* and 602*b* are partitioned by a partitioning portion 602*c* (portion for preventing the two ports from contacting each other), which runs between the ports 602*a* and 602*b*.

The filter portions 603 and 604 illustrated in FIG. 17 is in the form of an inversely positioned truncated cone; the filters are wider at the top end, or the opening, than at the bottom end. They are substantially equal in external diameter, but are different in configuration; the filter portion 604 has a partitioning groove 604*a* which runs across the top end of the filter portion 604, whereas the top end of the filter portion 603 has no groove. This groove 604*a* is shaped and oriented so that the partitioning portion 602*c* between the liquid supply ports 602*a* and 602*b* perfectly fits into the groove 604*a* when the filter portion 604 is fitted with the two liquid type liquid container 602.

With the provision of the above structure, the filter portion 603 fits with the single liquid type liquid container 601, but does not fit with the two liquid type liquid container 602, since the liquid supply port portion of the two liquid type liquid container 602 is provided with the partitioning portion 602*c*. On the other hand, the filter portion 604 fits with both the single liquid type liquid container 601 and two liquid type liquid container 602. Further, in order to fit the filter portion 604 with the liquid supply port portion of the two liquid type liquid container 602, the partitioning portion 602*c* between the liquid supply ports 602*a* and 602*b* must be fitted into the groove 604*a*, and this requirement regulates the orientation of the filter portion 604 when it is fitted with the liquid supply port portion of the two liquid type liquid container 602. Therefore, it does not occur that liquid flow parts are supplied with wrong liquid. In other words, in this embodiment, the liquid supply ports 602*a* and 602*b* are rendered different in configuration so that the ejection liquid and the bubble generation liquid are prevented from being supplied into the wrong liquid flow path.

As described above, according to this embodiment, the structures of the joint portions of the liquid container and the liquid ejection heads are such that the single liquid type liquid container can be attached to both the single liquid type head and the two liquid type head, whereas the two liquid type liquid container can be attached only to the two liquid type head.

In other words, in the case of a printer with a liquid ejection head and a liquid container whose joints are structured as described above, the user is prevented from erroneously attaching a two liquid type liquid container to a single liquid type head. Further, in the case of a printer provided with a two liquid type head, the user is allowed to optionally select a single liquid type ink container or a two liquid type ink container according to picture quality. Further, a liquid container for a conventional bubble jet type recording head may be provided with the same joint portion as the joint portion of a single liquid type liquid container, so that it can be used with a printer with a two liquid type head. With this arrangement, the user is allowed to use both an inexpensive conventional liquid container and a single liquid type liquid container. Further, the user can tell the difference between a single liquid type liquid container and a two liquid type liquid container from their external appearances, and therefore, it does not occur that the user buys a wrong ink container.

The joint structures for a liquid container and a liquid ejection head do not need to be limited to the configurations illustrated in the drawings. Any configuration is acceptable as long as it is capable of preventing a two liquid type liquid container from being attached to a wrong head. Next, liquid containers with a different version of joint structure will be described.

In the case of the two liquid type liquid container illustrated in FIG. 16, the blocking portion doubled as a partitioning plate between the ejection liquid and the bubble generation liquid. But, the blocking portion does not necessarily have to double as a partitioning plate. FIGS. 18, (*a*)–(*f*) depict modified versions of the joint structures described in the first embodiment. FIGS. 18, (*a*) and (*b*) are perspective views of a two liquid type liquid container and a single liquid type liquid container, respectively; FIGS. 18, (*c*) and (*d*), perspective cutaway views of the liquid containers illustrated in FIGS. 18, (*a*) and (*b*), depicting their internal structures; FIGS. 18, (*e*) and (*f*) are schematic perspective views of a two liquid type liquid ejection head and a single liquid type liquid ejection head correspondent to the liquid containers illustrated in FIGS. 18, (*a*), (*b*), (*c*) and (*d*), respectively. In these modifications, the two liquid type liquid ejection head is provided with two ink introduction tubes 703 and 704 through which bubble generation liquid and ejection liquid are introduced into the head, respectively. The single liquid type liquid ejection head is provided with an ink introduction tube 705 through which ejection liquid is introduced into the head. The ink introduction tubes 703 and 704 are round at the ink receiving end, whereas the ink introduction tube 705 is oval at the ink receiving end. As is evident from FIGS. 18, (*a*) and (*b*), the ink supply ports 701*a* and 701*b* of the liquid container 701, and the ink supply ports 702*a* of the liquid container 702, are shaped so that they perfectly fit with ink introduction tube filters 703 and 704, and an ink introduction tube filter 705, respectively. The single liquid type liquid container 702 has such a structure that allows the container 702 to be also attached to the two liquid type liquid ejection head illustrated in FIG. 18, (*e*).

In this modification, when the single liquid type liquid container 702 illustrated in FIG. 18, (*b*) is connected to the two liquid type head illustrated in FIG. 18, (*e*), certain areas of the liquid supply port 702*a* are not covered with the filter 703 or 704, which may allows liquid to leak from the joint. This type of leakage can be prevented by placing a negative pressure generating member 708 formed of urethane foam, one-way fiber bundle, or the like, in the single liquid type liquid container 702, immediately behind the liquid supply port 702*a*, as shown in FIG. 18, (*d*). The negative pressure generating member may be placed at the ink supply ports of the two liquid type liquid container 701. FIG. 18, (*c*) shows such negative pressure generating members 706 and 707 placed at the liquid supply ports 701*a* and 701*b* of the two liquid type liquid container 701. As a matter of fact, it is desirable that a two liquid type liquid container is also provided with negative pressure generating members, since the provision affords the simplification of the joint portion design for a two liquid type liquid ejection head, in terms of configuration, flow resistance relative to the liquid contained in a single liquid type liquid container and the liquid contained in a two liquid type liquid container, and the like.

A blocking portion does not necessarily have to be a part of a liquid supply port, nor be disposed at a location related to liquid supplying function. It may be optionally disposed as long as it properly functions as a blocker. FIGS. 19, (*a*)–(*d*), and FIGS. 20, (*a*)–(*d*), illustrate such modifications of the primary embodiment of the present invention, in which a blocking portion is disposed at a location other than the opening of an ink supply port.

FIGS. 19, (*a*)–(*d*) illustrate modified version of the first embodiment of the present invention. FIGS. 19, (*a*) and (*b*) are schematic perspective views of a two liquid type liquid container and a single liquid type liquid container, respectively, and FIGS. 19, (*c*) and (*d*) are schematic perspective views of the holders for a two liquid type liquid container and a single liquid type liquid container, respectively.

A modified two liquid type liquid container 711 and a modified single liquid type liquid container 712 are provided with liquid supply ports 711*a* and 711*b*, and liquid supply ports 712*a* and 712*b*, respectively. The single liquid type liquid container 712 is provided with two liquid supply ports, but contains only one liquid.

The liquid supply ports 711*a* and 712*a* are the same in configuration, and the liquid supply ports 711*b* and 712*b* are the same in configuration. However, the liquid supply port portions in this modification do not have a feature which enables the liquid supply port portion to function as a blocking portion. Only visible difference between the two liquid type liquid container and the single liquid type liquid container is that the top surface of the two liquid type liquid container is provided with a projection 711*c*.

Referring to FIGS. 18, (*c*) and (*d*), both liquid ejecting portions are provided with a holder portion so that liquid containers can be easily attached to the liquid ejection heads. More specifically, both holder portions are provided with a structure which enables each holder portion to hold four liquid containers, each of which contains a different liquid (for example, yellow ink, magenta ink, cyan ink, and black ink). These liquid ejection heads with the holder portion are mounted on the carriage of a recording apparatus to record color images.

The holder portion is provided with filters 717(*a*) and 717(*b*) which can fit with the liquid supply ports of both liquid containers. Liquid is supplied to the liquid ejection head through these filters. Between the two holder portions, the holder portion 713 of the two liquid type head is provided with a notch 715 (recessed portion) which corresponds to the projection 711*c* of the two liquid type liquid container, but the corresponding portion of the holder portion 714 of the single liquid type head is not provided with a notch.

Therefore, the single liquid type liquid container can be installed in both the holder portion of the single liquid type liquid ejection head, and the holder portion of the two liquid type liquid ejection head, but the two liquid type liquid container, being provided with the projection 711*c*, can be installed in the holder portion 713 of the two liquid type liquid ejection head, which is provided with the notch 715 correspondent to the projection 711*c* as illustrated in FIG. 19, (*c*), but cannot be installed in the holder portion 714 of the single liquid type liquid ejection head, which is provided with no notch as illustrated in FIG. 19, (*d*).

FIGS. 20, (*a*)–(*d*) are schematic views of another example of the modified version of the liquid container in accordance with the present invention. In this modification, a single liquid type liquid container has a supply port 722*a* and a groove 722*b*, and a two liquid type liquid container 721 has a bubble generation liquid supply port 721*a* and an ejection liquid supply port 721*b*. The holder portion 724 of a single liquid type liquid ejection head is provided with a tongue-like portion 725 correspondent to the groove 722*b*, whereas the holder portion 723 of the two liquid type liquid ejection head is not provided with a tongue-like portion. The holder portion 723 is provided with filters 726*a* and 726*b* which correspond to the liquid supply ports 721*a* and 721*b* of the liquid container 721, respectively, and the holder portion 724 is provided with a filter 727 which corresponds to the liquid supply port 722*a* of the liquid container 722. In this modification, the tongue-like portion 725 of the holder portion 724 constitutes a blocking portion.

Figure 21:
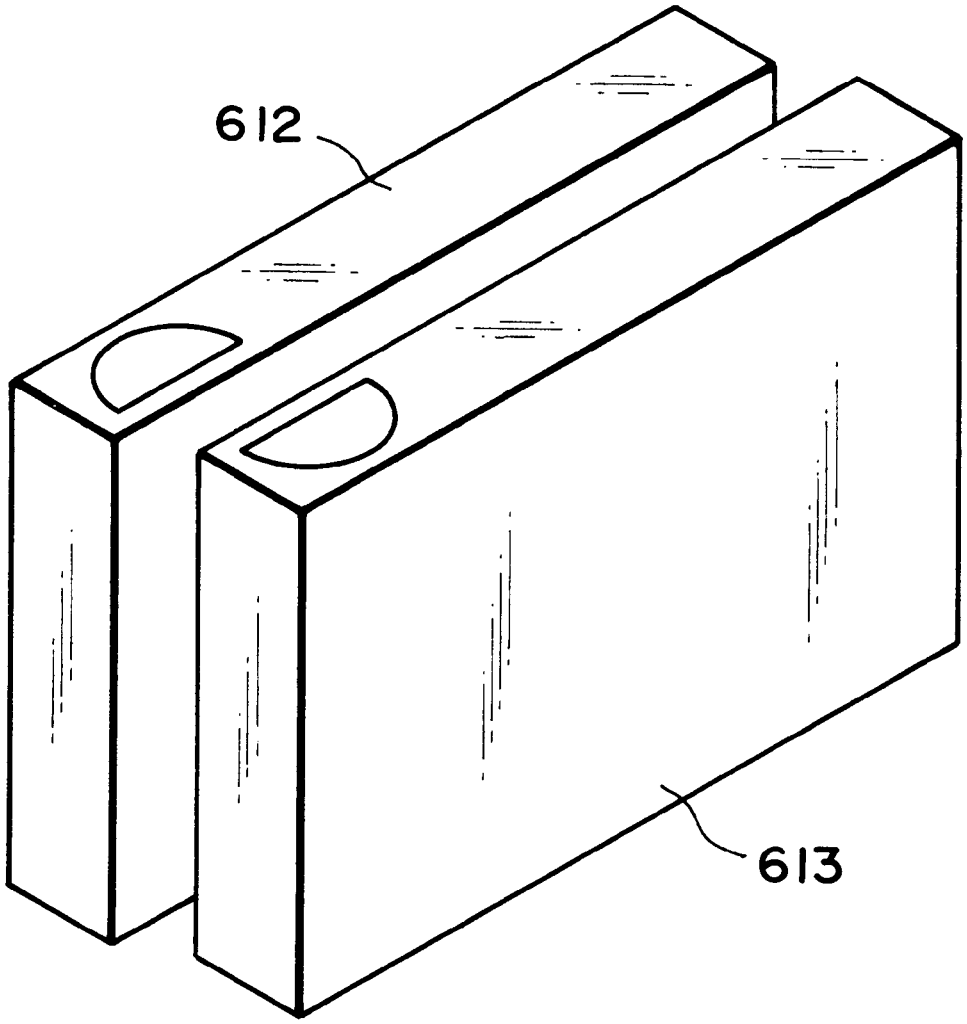
FIG. 21 is a perspective view of a two-liquid type liquid container according to another embodiment of the present invention.

In the various modifications described above, all the two liquid type liquid containers were structured to separately contain ejection liquid and bubble generation liquid, but this structure is not essential. For example, the two liquid type liquid container 602 illustrated in FIG. 16 may be replaced by two separate liquid containers 612 and 613 illustrated in FIG. 21, which correspond to imaginary two containers, respectively, creatable by splitting the container 602 at a plane passed lengthwise through the partitioning portion 602*c*.

Needless to say, in order to prevent ejection liquid or bubble generation liquid from being supplied into the wrong liquid path of a two liquid type liquid ejection head, not only may a liquid supply port be varied in configuration, but also in location.

It is not necessary for a liquid container for bubble generation liquid to be easily connectable to, or separable from, the recording head portion of a liquid ejection head, as long as a liquid ejection head is structured so that the bubble generation liquid in a two liquid type liquid ejection head is prevented from being inadvertently introduced into a wrong liquid flow path of another liquid ejection head.

FIGS. 22, (*a*)–(*d*) are schematic perspective view of liquid containers and liquid ejection heads modified to satisfy the requirement described in the preceding paragraph. FIGS. 22, (*a*) and (*b*) are schematic perspective views of a two liquid type liquid container and a single liquid type liquid container, respectively. FIGS. 22, (*c*) and (*d*) are schematic perspective views of a two liquid type liquid ejection head and a single liquid type liquid ejection head, respectively.

In this modification, a two liquid type liquid container 731 contains only ejection liquid, and bubble generation liquid is supplied to a recording head, through a bubble generation liquid introduction tube 733 illustrated in FIG. 22, (*c*), an unillustrated tube, and the like, from a bubble generation liquid container (unillustrated) disposed in a recording apparatus, at a location away from the recording head.

The liquid supply ports 732*a* and 731*a* of the single liquid type liquid container and the two liquid type liquid container, respectively, are sealed with an elastic member formed of material such as rubber, and contain liquid.

On the other hand, a single liquid type head portion 738 and a two liquid type head portion 735 are provided with ink introduction tubes 737 and 734, like a hollow needle, for introducing liquid into the recording head portions, respectively. The two liquid type head portion 735 is provided with a recessed portion 736 which fits with a projection 731*b* of the two liquid type liquid container 731, which is located on the wall with the ink supply port. In this modification, a projection 731*b* of the two liquid type liquid container 731, which is located on the surface which comes in contact with the recording head portion, prevents the two liquid type liquid container 731 from being connected to the single liquid type liquid ejection head. However, the single liquid type liquid container can be connected to the two liquid type liquid ejection head, since the structures of the two liquid type liquid container 731 and the single liquid type liquid container 731 are substantially the same, except for the projection 731*b* of the two liquid type liquid container 731.

In the above description of the liquid containers and liquid ejection heads, the liquid ejection recording apparatus in which the liquid container or containers were installed was described as a liquid ejection head in which only a single liquid container and a single recording head can be mounted, but needless to say, the present invention is applicable to a liquid ejection color recording apparatus or the like in which a plurality of liquid containers for holding a plurality of liquids of different color, and a corresponding number of recording head are provided. In the case of the latter apparatus, the plurality of liquid containers may be rendered identifiable by attaching a conventional color (or liquid type) label to each liquid container, so that the user is prevented from attaching to a recording head, a container which contains ink of wrong color.

Embodiment 2

In the preceding embodiment, only one type of liquid was contained in a liquid container, but there are times when various kinds of ejection liquids (for example, ejection liquids of different color) are used. In order to deal with such situations, a liquid container comprising a plurality of liquid cells is sometimes used instead of a plurality of ordinary liquid containers. Thus, in this embodiment, the present invention will be described with reference to a liquid container which comprises a plurality of liquid cells to hold plurality of liquids in a single liquid container with multiple liquid cells.

Figure 23:
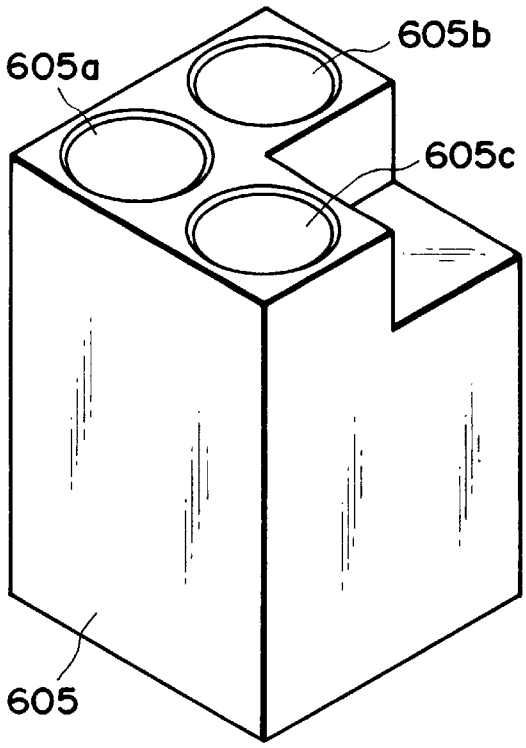
FIG. 23 is a perspective view of a single-liquid type liquid container for accommodating a plurality of ejection liquids according to an embodiment of the present invention.
Figure 24:
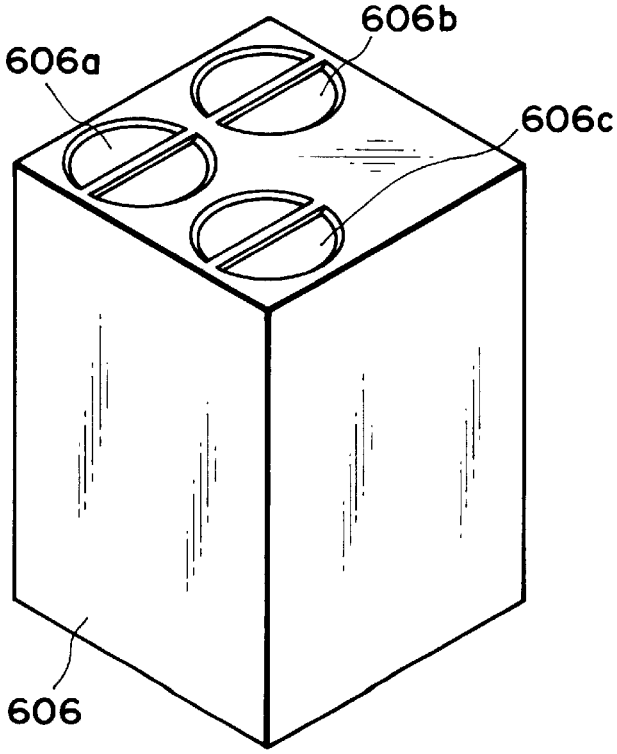
FIG. 24 is a perspective view of a two-liquid type liquid container for accommodating a plurality of ejection liquids according to an embodiment of the present invention.

FIG. 23 is a perspective view of a liquid container which comprises a plurality of single liquid type liquid cells to hold a plurality of liquids. FIG. 24 is ia perspective view of a liquid container which comprises a plurality of two liquid type liquid cells to hold a plurality of liquids.

A liquid container 605 illustrated in FIG. 23 is provided with liquid supply ports 605*a*, 605*b* and 605*c* which are the same in configuration as the liquid supply port 601*a* illustrated in FIG. 15. It can be fitted with both the filter portion 603, and the filter portion 604 provided with the partitioning groove 604*a*, which are illustrated in FIG. 17. Three type of liquids are separately contained in their own liquid cells, and are individually supplied to a liquid ejection head through their own liquid supply ports 605*a*, 605*b* and 605*c*.

A two liquid type liquid container 606 illustrated in FIG. 24 is provided with liquid supply ports 606*a*, 606*b*, and 606*c* which are the same in configuration as the liquid supply port 602*a* with the partitioning portion 602*c* illustrated in FIG. 16. It can be fitted with only the filter portion 604 with the partitioning groove 604*a* illustrated in FIG. 17. It separately contains three type of ejection liquids and three types of bubble generation liquids, and these separately held liquids are supplied to a liquid ejection head through their own liquid supply ports 606*a*, 606*b* and 606*c*.

With the provision of the above structure, even when a plurality of ejection liquids contained in a single liquid container with three (or six) liquid cells are used, a two liquid type liquid container is prevented from being inadvertently attached to a single liquid type liquid ejection head; in other words, the same effects as those described in the first embodiment can be obtained.

Embodiment 3

If a single liquid type liquid container is attached to a two liquid type head such as the one described above, the ejection liquid supplied from this liquid container is used also as bubble generation liquid. In such a case, the voltage applied to a heat generating member may be lowered since the viscosity of the ejection liquid is low. When the voltage applied to a heat generating member may be lowered as it is in this case, electric power consumption and ink consumption are reduced by reducing driving power and number of preliminary pulses.

On the other hand, when a two liquid type liquid container is attached to a two liquid type head, the liquid container may contain ejection liquid with high viscosity prepared for the purpose of improving recording performance. In such a case, the voltage applied to a heat generating member must be increased. When it is necessary to increase the voltage applied to a heat generating member, driving power and number of preliminary pulses must be increased.

As described above, between when a single liquid type liquid container is attached to a two liquid type liquid ejection head, and when a two liquid type liquid container is attached to a two liquid type liquid ejection head, bubble generation characteristic and liquid ejection characteristics of the two liquid type liquid ejection change, and therefore, it is necessary to set proper values for the voltage to be applied to a heat generating member, the driving pulse width, and the like, according to the type of the liquid container attached to the two liquid type liquid ejection head, so that the two liquid type liquid ejection head is properly driven, and the so-called recovery operation is properly carried out.

This knowledge can be used in the following manner. For example, when a negative pressure generation type liquid container to be used with a conventional bubble jet system is connected to a two liquid type head, driving frequency should be slightly reduced compared to when a two liquid type liquid container is attached a two liquid type head. With this arrangement, a certain amount of ink which will be left unused in a conventional negative pressure generation type liquid container, that is, the ink which could not be ejected by a conventional bubble jet head due to increase in the negative pressure generated by the conventional ink container, can be partially ejected; in other words, the ink usage efficiency of a conventional liquid container can be improved.

In this embodiment, in order to identify whether the liquid container having attached to a liquid ejection head is of a single liquid type or a two liquid type, a single liquid type liquid container and a two liquid type liquid container are structured as described below.

Figure 25:
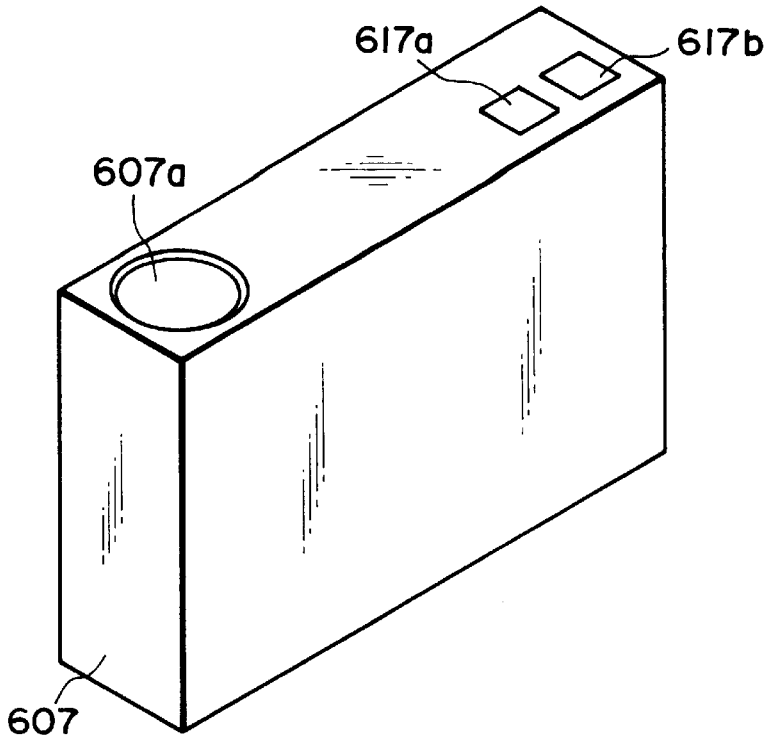
FIG. 25 shows an example of an electrode pad formed on a single-liquid type liquid container.

Referring to FIG. 25, a single liquid type liquid container 607 is provided with a liquid supply port 607*a* which is the same in configuration as the liquid supply port 601*a* illustrated in FIG. 15, and two electrode pads 617*a* and 617*b*, which are located on the top surface.

Figure 26:
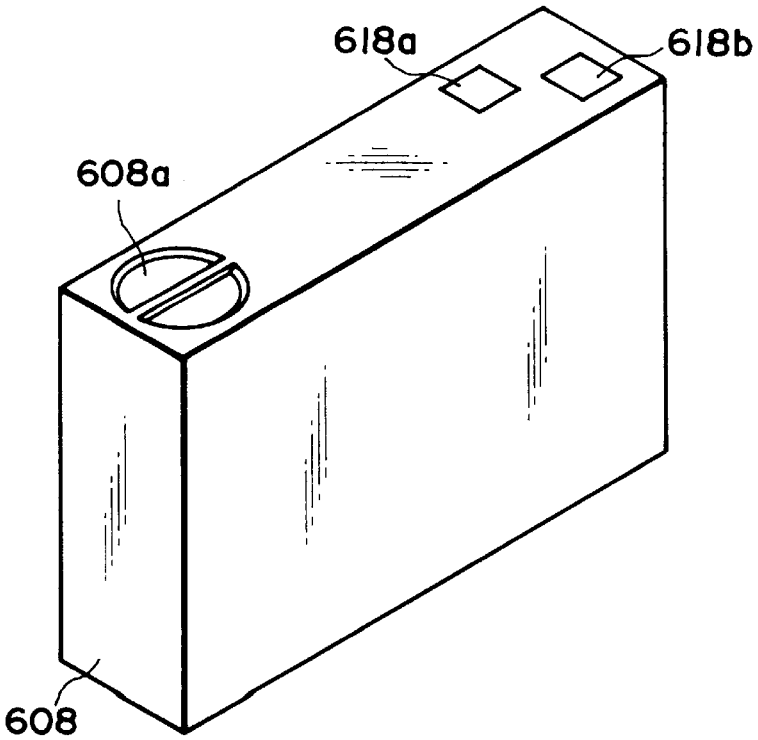
FIG. 26 shows an example of an electrode pad formed on a two-liquid type container.

Referring to FIG. 26, a two liquid type liquid container 608 is provided with a liquid supply port 608*a* which is the same in configuration as the liquid supply port 602*a* illustrated in FIG. 16, and is also provided with two electrode pads 618*a* and 618*b*, which are also located on the top surface, but are different in positional arrangement from the electrode pads 617*a* and 617*b*.

The liquid container mounting portion (carriage) of a liquid ejection apparatus, on which the aforementioned single liquid type liquid container 607 or the two liquid type liquid container 608 is mounted, is provided with electrode pins which are positioned to correspond to the electrode pads 617*a*, 617*b*, 618*a* or 618*b*, so that the type of the liquid container having been mounted on the carriage can be identified on the basis of which electrode pads are in connection with which electrode pins.

In the case of the liquid ejection apparatus in this embodiment, the CPU 302 of the recording apparatus illustrated in FIG. 14 detects whether the mounted liquid container is the single liquid type liquid container 607 or the two liquid type liquid container 608, on the basis of the type of the connections between the electrodes pads and the electrode pins, and carries out a proper ejecting operation or a recovery operation (recovery sequence). For example, when the mounted liquid container is the single liquid type liquid container 607, the CPU reduces bubble generation power (size of the bubble generating region) during the liquid ejecting operation or the recovery operation, and when the mounted liquid container is the two liquid type liquid container 608, it increases bubble generation power (size of the bubble generating region) during the liquid ejecting operation and the recovery operation. More specifically, the bubble generation power is controlled by reducing or increasing the voltage to be applied to a heat generating member.

Also according to this embodiment, it is possible to prevent a two liquid type liquid container from being inadvertently connected to a single liquid type liquid ejection head; in other words, the same effects as those described in the first embodiment can be obtained.

In the above description of this embodiment, the present invention was described with reference to a liquid ejection recording apparatus in which only one cartridge is mountable, but it is needless to say that the present invention is also applicable to a liquid ejection recording apparatus in which a plurality of cartridges containing liquid of different color are mountable together. In the case of the latter apparatus, the types of the liquid containers prepared for various liquids are detected by a detection element such as the aforementioned electrode pad. But the types of liquids must be identifiable by the user so that the user is prevented from connecting a liquid container filled with wrong liquid to the liquid ejection head. This may be accomplished by preparing conventional color (liquid type) labels as described in the first embodiment.

Embodiment 4

According to the preceding description of the third embodiment of the present invention, which type of liquid container is in connection with the two liquid type liquid ejection head is determined on the basis of the types of the connection between the electrode pads provided on the liquid container side, and the electrode pins provided on the apparatus main assembly side. This method can be adopted to regulate the liquid flow from a two liquid type liquid container to a single liquid type head.

For example, a liquid container or a liquid ejection head is provided with a control valve for controlling the liquid supply to the liquid ejection head. The CPU 302 of a recording apparatus detects whether the mounted liquid container is a single liquid type liquid container or not, on the basis of the types of the connection between the electrode pads and the electrode pads, and only when the mounted liquid container is a single liquid type liquid container, it opens the control valve to allow the liquid to be supplied to the liquid ejection head. In this case, it is desirable that the control section allows the liquid ejection head to eject liquid only when the mounted liquid container is a single liquid type liquid container.

Further, when the liquid in a two liquid type liquid container is prevented from being supplied to a single liquid type head, on the basis of the types of the connection between the electrode pads provided on the liquid container side, and the electrode pins provided on the apparatus main assembly side, as described in this embodiment, the liquid supply port of the single liquid type liquid container and the two liquid type liquid container may be the same in configuration, and connectable to both the single liquid type head and the two liquid type head. This is due to the fact that even if a two liquid type liquid container is connected to a single liquid type head, no liquid is supplied to the single liquid type head.

Other Examples

Other examples of the liquid ejecting head applicable to the present invention will be described. In the following description, one of the single-liquid and two-liquid type will be taken, but the examples are applicable to either of them, unless particularly stated to the contrary.

<Configuration of the Ceiling of Liquid Flow Path>

Figure 27:
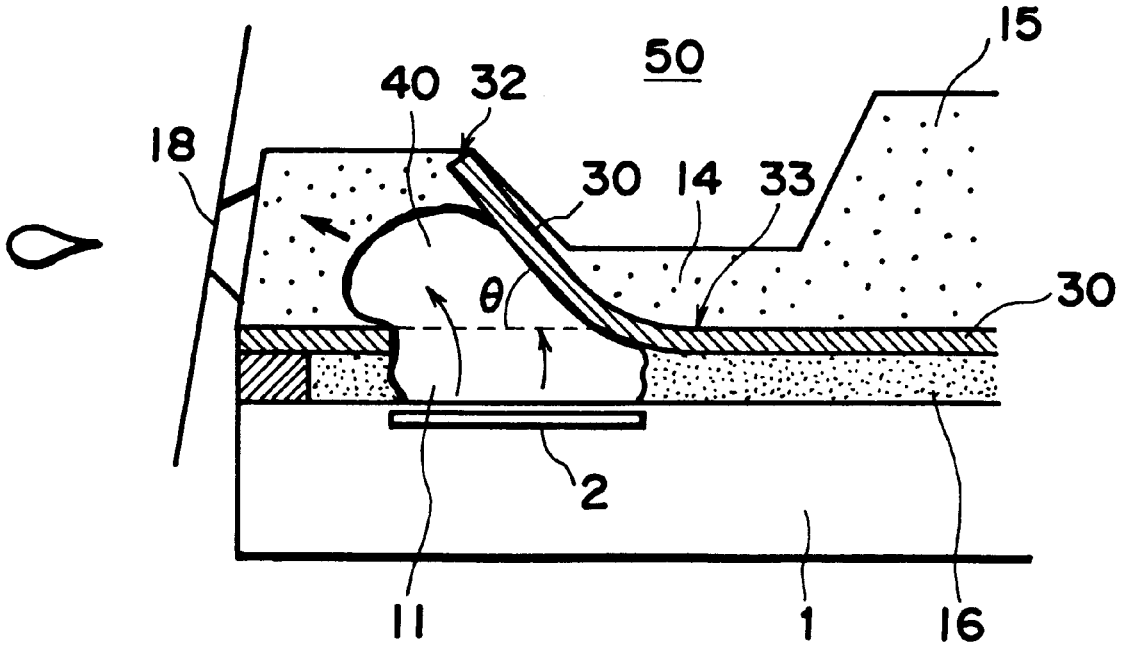
FIG. 27 illustrates a structure of a movable member and a first liquid flow path.

FIG. 27 illustrates a structure of a movable member and a first liquid flow path.

As shown in in FIG. 27, a grooved member 50 having grooves for constituting first liquid flow paths 13 (or liquid flow path 10 in FIG. 1), is provided on the separation wall 30. In this example, the first liquid flow path has an ceiling adjacent the free end of the movable wall which is higher to permit larger movable angle θ of the movable member 31. The movable range of the movable member may be determined on the basis of the structures of the flow path, the durability of the movable member, the bubble generation power and/or the like. It is preferable that angle is wide enough to include the direction of the ejection outlet.

By making the displacement height of the free end of the movable member larger than the diameter of the ejection outlet, as shown in the Figure, the ejection powers sufficiently transmitted. As shown in the figure, the height of the liquid flow path ceiling at the position of the fulcrum 33 of the movable member is smaller than the height of the liquid flow path ceiling at the position of the free end 32 of the movable member, and therefore, the release of the pressure wave due to the displacement of the movable member toward the upstream can be effectively prevented.

<Positional Relation Between Second Liquid Flow Path and Movable Member>

Figure 28A:
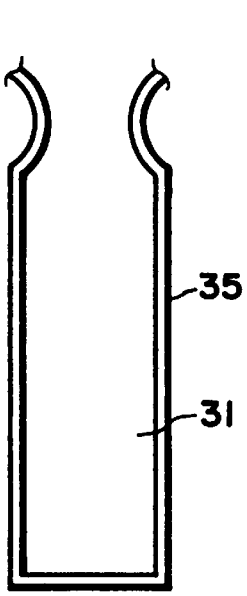
FIGS. 28(*a*)–(*c*) are illustrations of a structures of a movable member and a liquid flow path.
Figure 28B:
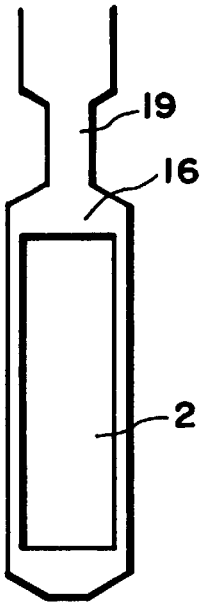
Figure 28C:
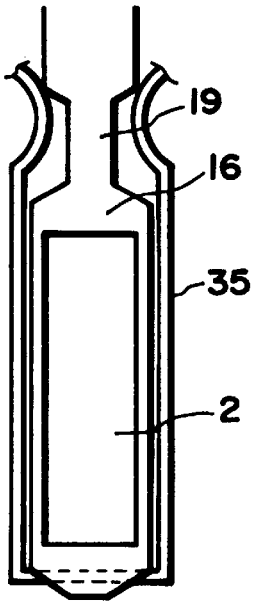

FIG. 28 is an illustration of a positional relation between the above-described movable member 31 and second liquid flow path 16, and (a) is a view of the movable member 31 position of the partition wall 30 as seen from the above; (b) is a view of the second liquid flow path 16 seen from the above without partition wall 30; and (c) is a schematic view of the positional relation between the movable member 6 and the second liquid flow path 16 wherein the elements are overlaid. In these Figures, the bottom is a front side having the ejection outlets.

The second liquid flow path 16 of this example has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this example, much or most of the ejected liquid is from the first liquid flow path, and the bubble generation liquid in the second liquid flow path having the heat generating element is not consumed much, so that filling amount of the bubble generation liquid to the bubble generation region 11 may be small. Therefore, the clearance at the throat portion 19 can be made very small, for example, as small as several μm—ten and several μm, so that release of the pressure produced in the second liquid flow path can be further suppressed and to further concentrate it to the movable member side. The pressure can be used as the ejection pressure through the movable member 31, and therefore, the high ejection energy use efficiency and ejection pressure can be accomplished. The configuration of the first liquid flow path 16 is not limited to the one described above, but may be any if the pressure produced by the bubble generation is effectively transmitted to the movable member side.

As shown in FIG. 28, (*c*), the lateral sides of the movable member 31 cover respective parts of the walls constituting the second liquid flow path so that falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

In FIG. 12, (*b*) and FIG. 27, a part of the bubble generated in the bubble generation region of the second liquid flow path 4 with the displacement of the movable member 6 to the first liquid flow path 14 side, extends into the first liquid flow path 14 side by selecting the height of the second flow path to permit such extension of the bubble, the ejection force is further improved as compared with the case without such extension of the bubble. To provide such extending of the bubble into the first liquid flow path 14, the height of the second liquid flow path 16 is preferably lower than the height of the maximum bubble, more particularly, the height is preferably several μm—30 μm, for example. In this example, it is 15 μm.

<Movable Member and Separation Wall>

Figure 29A:
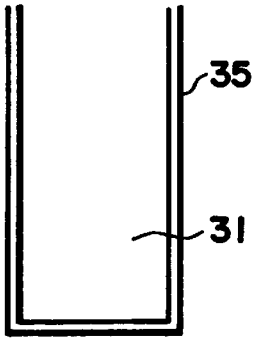
FIGS. 29(*a*)–(*c*) are illustrations of structures of a movable member.
Figure 29B:
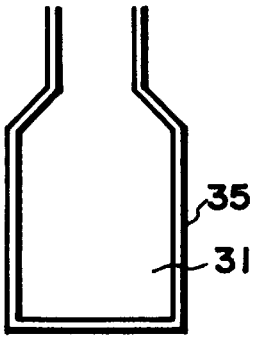
Figure 29C:
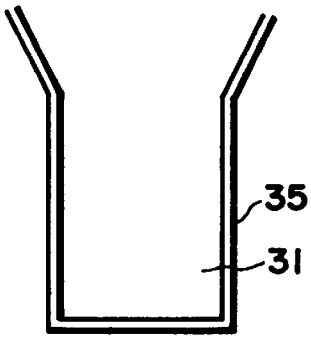

FIG. 29 shows another example of the movable member 31, wherein reference numeral 35 designates a slit formed in the partition wall, and the slit is effective to provide the movable member 31. In the Figure, (a), the movable member has a rectangular configuration, and in (b), it is narrower in the fulcrum side to permit increased mobility of the movable member, and in (c), it has a wider fulcrum side to enhance the durability of the movable member.

In FIG. 29, designated by 35 is a slit provided in the separation wall, and the movable member 31 is formed by the slit. The configuration narrowed and arcuated at the fulcrum side is desirable as shown in FIG. 28, (*a*), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 μm, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nitrile group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy *thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

In this example, the movable member has a thickness of μm order as preferable thickness, and a movable member having a thickness of cm order is not used in usual cases. When a slit is formed in the movable member having a thickness of μm order, and the slit has the width (W μm) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 13, 14 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

When the separated bubble generation liquid and ejection liquid are used as has been described hereinbefore, the movable member functions in effect as the separation member. When the movable member moves in accordance with generation of the bubble, a small amount of the bubble generation liquid may be mixed into the ejection liquid. Usually, the ejection liquid for forming an image in the case of the ink jet recording, contains 3% to 5% approx. of the coloring material, and therefore, if content of the leaked bubble generation liquid in the ejection liquid is not more than 20%, no significant density change results. Therefore, the present invention covers the case where the mixture ratio of the bubble generation liquid of not more than 20%.

In the foregoing embodiment, the mixing of the bubble generation liquid is at most 15%, even if the viscosity thereof is changed, and in the case of the bubble generation liquid having the viscosity not more than 5 cP, the mixing ratio was at most 10% approx., although it is different depending on the driving frequency.

The ratio of the mixed liquid can be reduced by reducing the viscosity of the ejection liquid in the range below 20 cps (for example not more than 5%).

The description will be made as to positional relation between the heat generating element and the movable member in this head. The configuration, dimension and number of the movable member and the heat generating element are not limited to the following example. By an optimum arrangement of the heat generating element and the movable member, the pressure upon bubble generation by the heat generating element, can be effectively used as the ejection pressure.

Figure 30:
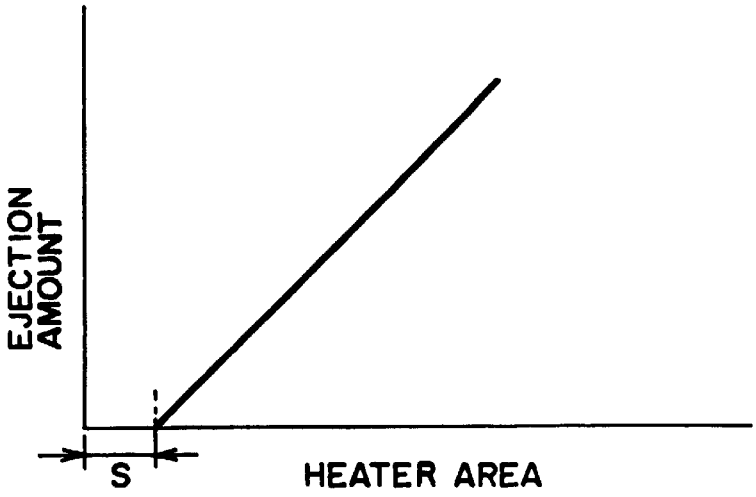
FIG. 30 shows a relation between an area of a heat generating element and an ink ejection amount.

FIG. 30 shows a relation between an area of a heat generating element and an ink ejection amount.

In a conventional bubble jet recording method, energy such as heat is applied to the ink to generate instantaneous volume change (generation of bubble) in the ink, so that ink is ejected through an ejection outlet onto a recording material to effect printing. In this case, the area of the heat generating element and the ink ejection amount are proportional to each other. However, there is a non-bubble-generation region S not contributable to the ink ejection. This fact is confirmed from observation of burnt deposit on the heat generating element, that is, the non-bubble-generation area S extends in the marginal area of the heat generating element. It is understood that marginal approx. 4 μm width is not contributable to the bubble generation.

In order to effectively use the bubble generation pressure, it is preferable that movable range of the movable member covers the effective bubble generating region of the heat generating element, namely, the inside area beyond the marginal approx. 4 μm width. In this example, the effective bubble generating region is approx. 4 μm and inside thereof, but this is different if the heat generating element and forming method is different.

Figure 31A:
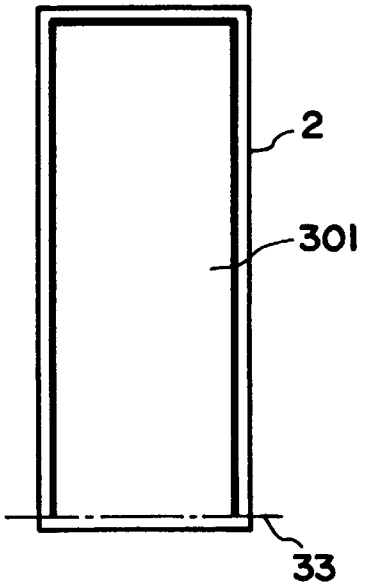
FIGS. 31(*a*)–(*b*) show positional relationships a movable member and a heat generating element.
Figure 31B:
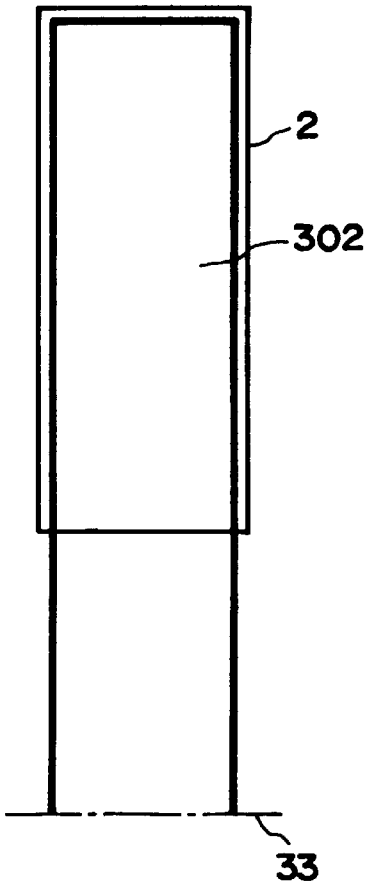

FIG. 31 is a schematic view as seen from the top and showing a positional relation ship between the movable member and the heat generating element, wherein the use is made with a heat generating element 2 of 58×150 μm, and with a movable member 301, (a) in the Figure, and a movable member 302, (b), in the Figure which have different total area.

The dimension of the movable member 301 is 53×145 μm, and is smaller than the area of the heat generating element 2, but it has an area equivalent to the effective bubble generating region of the heat generating element 2, and the movable member 301 is disposed to cover the effective bubble generating region. On the other hand, the dimension of the movable member 302 is 53×220 μm, and is larger than the area of the heat generating element 2 (the width dimension is the same, but the dimension between the fulcrum and movable leading edge is longer than the length of the heat generating element), similarly to the movable member 301. It is disposed to cover the effective bubble generating region. The tests have been carried out with the two movable members 301 and 302 to check the durability and the ejection efficiency. The conditions were as follows:

Bubble generation liquid:

aqueous solution of ethanol (40%)

Ejection ink: dye ink

Voltage: 20.2 V

Frequency: 3 kHz

The results of the experiments show that movable member 301 was damaged at the fulcrum when $1\times10^7$ pulses were applied. (b) The movable member 302 was not damaged even after $3\times10^8$ pulses were applied. Additionally, the ejection amount relative to the supplied energy and the kinetic energy determined by the ejection speed, are improved by approx. 1.5–2.5 times.

From the results, it is understood that movable member having an area larger than that of the heat generating element and disposed to cover the portion right above the effective bubble generating region of the heat generating element, is preferable from the standpoint of durability and ejection efficiency.

Figure 32:
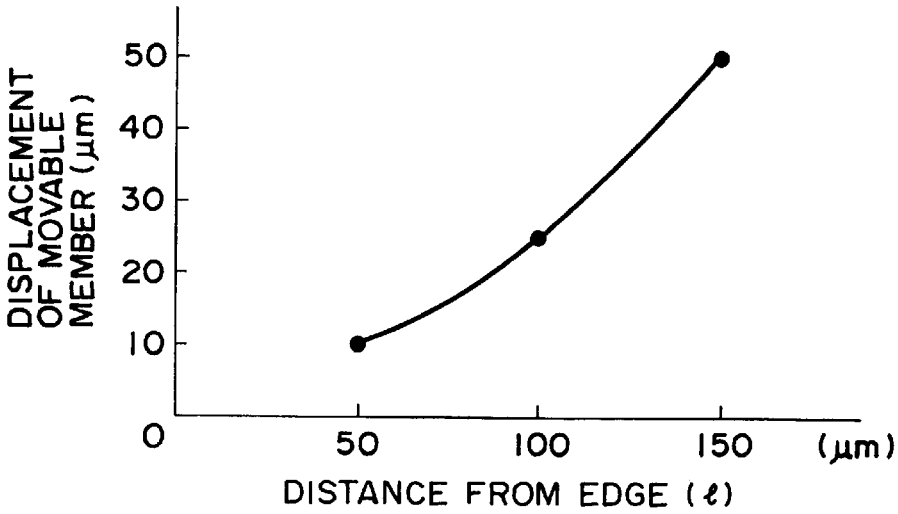
FIG. 32 shows a relation between a distance from an edge of a heat generating element to a fulcrum and a displacement of the movable member.
Figure 33:
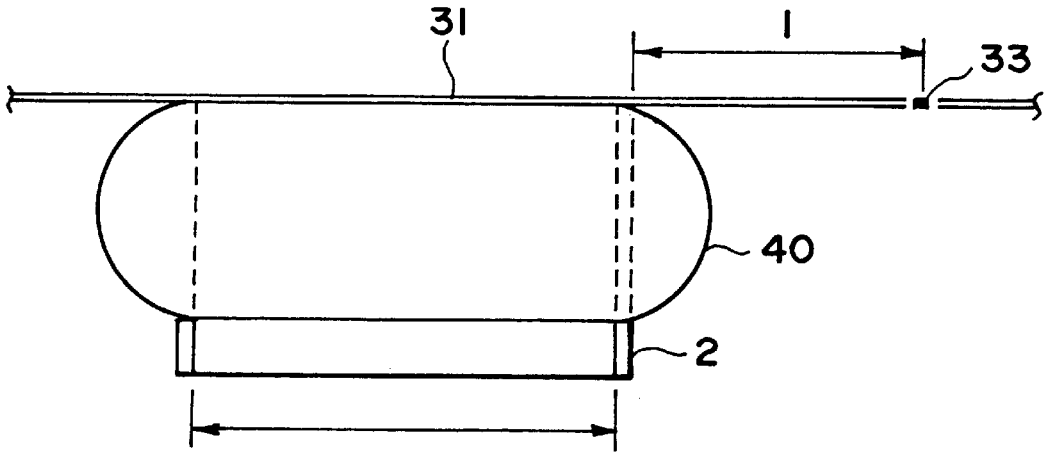
FIG. 33 illustrates a positional relation between a heat generating element and a movable member.

FIG. 32 shows a relation between a distance between the edge of the heat generating element and the fulcrum of the movable member and the displacement of the movable member.

The heat generating element 2 has a dimension of 40×105 μm. It will be understood that displacement increases with increase with the distance 1 from the edge of the heat generating element 2 and the fulcrum 33 of the movable member 31. Therefore, it is desirable to determinate the position of the fulcrum of the movable member on the basis of the optimum displacement depending on the required ejection amount of the ink, flow passage structure, heat generating element configuration and so on. The experiments by the inventors have revealed that when the fulcrum is provided right above the effective bubble generating region, the movable wall is damaged after application of $1\times10^6$ pulses, that is, the durability is lower. Therefore, by disposing the fulcrum of the movable member outside the right above position of the effective bubble generating region of the heat generating element, a movable member of a configuration and/or a material not providing very high durability can be practically usable. On the other hand, even if the fulcrum is right above the effective bubble generating region, it is practically usable if the configuration and/or the material is properly selected. By doing so, a liquid ejecting head with the high ejection energy use efficiency and the high durability can be provided.

<Element Substrate>

The description will be made as to a structure of the element substrate provided with the heat generating element for heating the liquid.

Figure 34A:
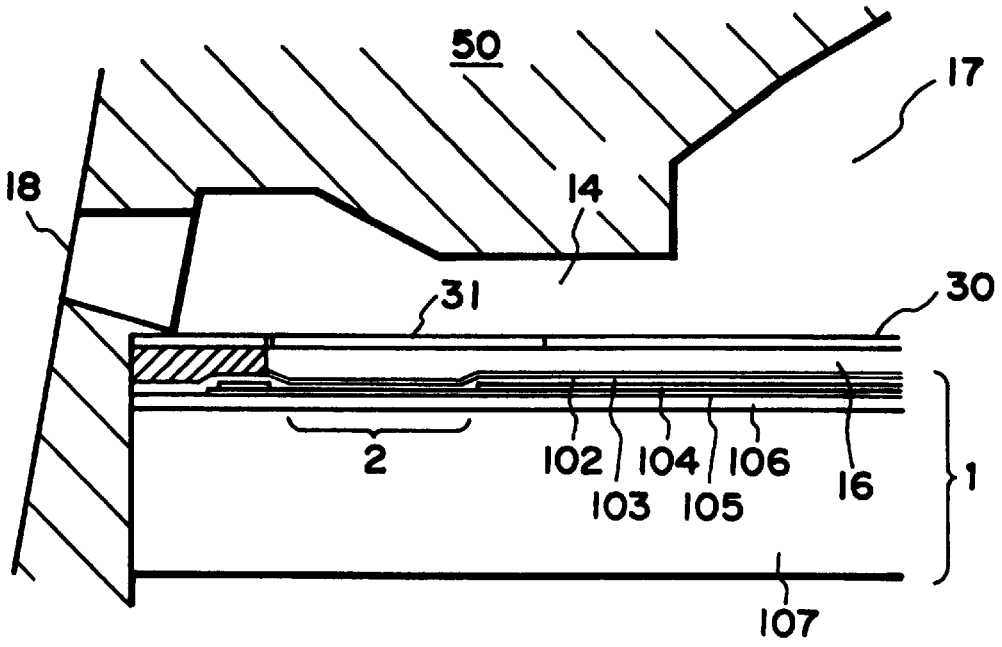
FIGS. 34(*a*)–(*b*) are longitudinal sectional views of a liquid ejecting head according to an embodiment of the present invention.
Figure 34B:
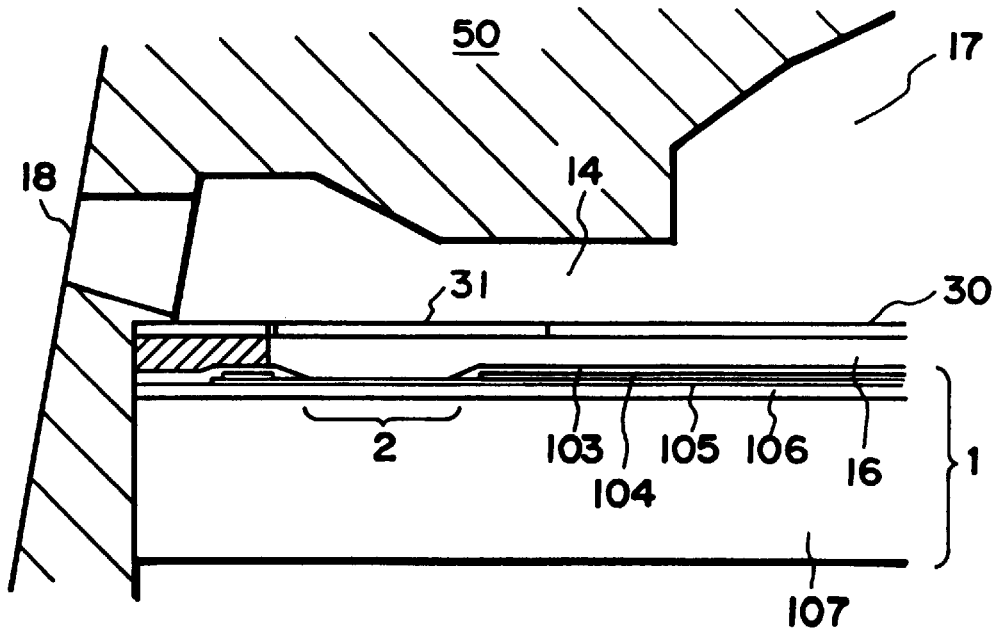

FIG. 34 is a longitudinal section of the liquid ejecting head applicable to the present invention. On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 12, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material one of such examples is shown in FIG. 22, (*b*). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In this example, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selectively driving the electrothermal transducer element may also be integrally built in, in addition to the resistance layer 105 constituting the heat generation portion and the electrothermal transducer constituted by the wiring electrode 104 for supplying the electric signal to the resistance layer.

In order to eject the liquid by driving the heat generation portion of the electrothermal transducer on the above-described element substrate 1, the resistance layer 105 is supplied through the wiring electrode 104 with rectangular pulses as shown in FIG. 23 to cause instantaneous heat generation in the resistance layer 105 between the wiring electrode.

Figure 35:
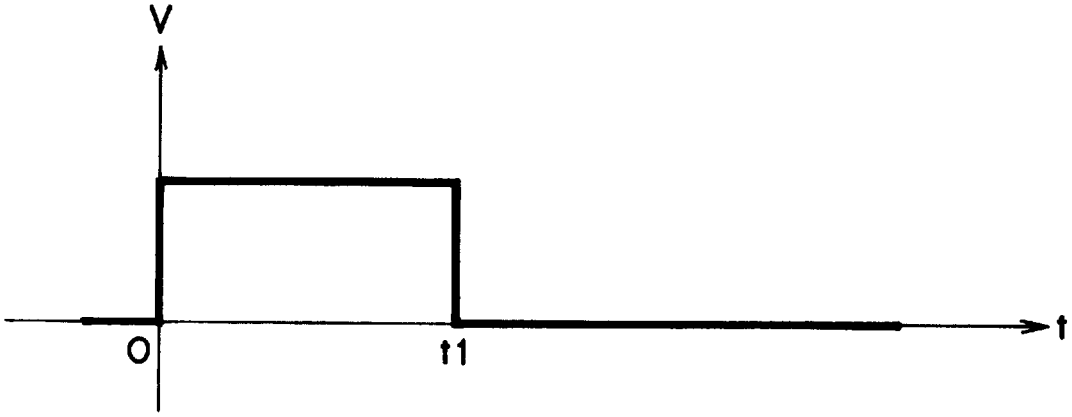
FIG. 35 is a schematic view showing a configuration of a driving pulse.

FIG. 35 is a schematic view showing a configuration of a driving pulse.

In the case of the heads of the foregoing examples, the applied energy has a voltage of 24 V, a pulse width of 5 μsec, for the first heat generating element, and a pulse width 10 μsec for the second heat generating element at the timed relation as described hereinbefore to drive the heat generating element, by which the liquid ink is ejected through the ejection outlet through the process described hereinbefore. However, the driving signal conditions are not limited to this, but may be any if the bubble generation liquid is properly capable of bubble generation.

<Head Structure for 2 Flow Paths>

The description will be made as to a structure of the liquid ejecting head with which different liquids are separately accommodated in first and second common liquid chamber, and the number of parts can be reduces so that manufacturing cost can be reduced.

Figure 36:
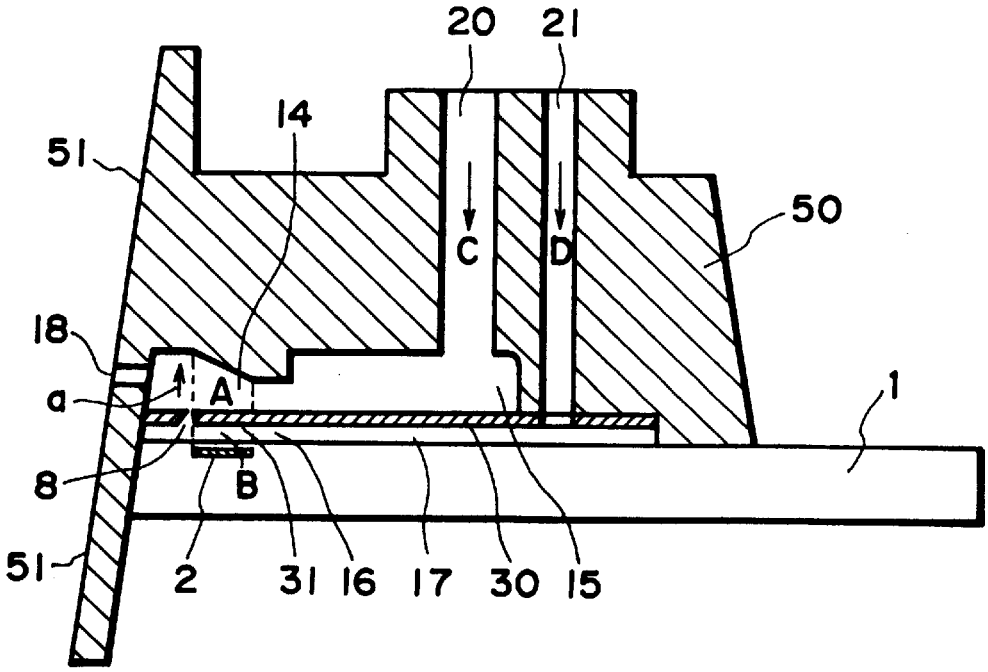
FIG. 36 is a sectional view illustrating a supply passage of a liquid ejecting head applicable to the present invention.
Figure 37:
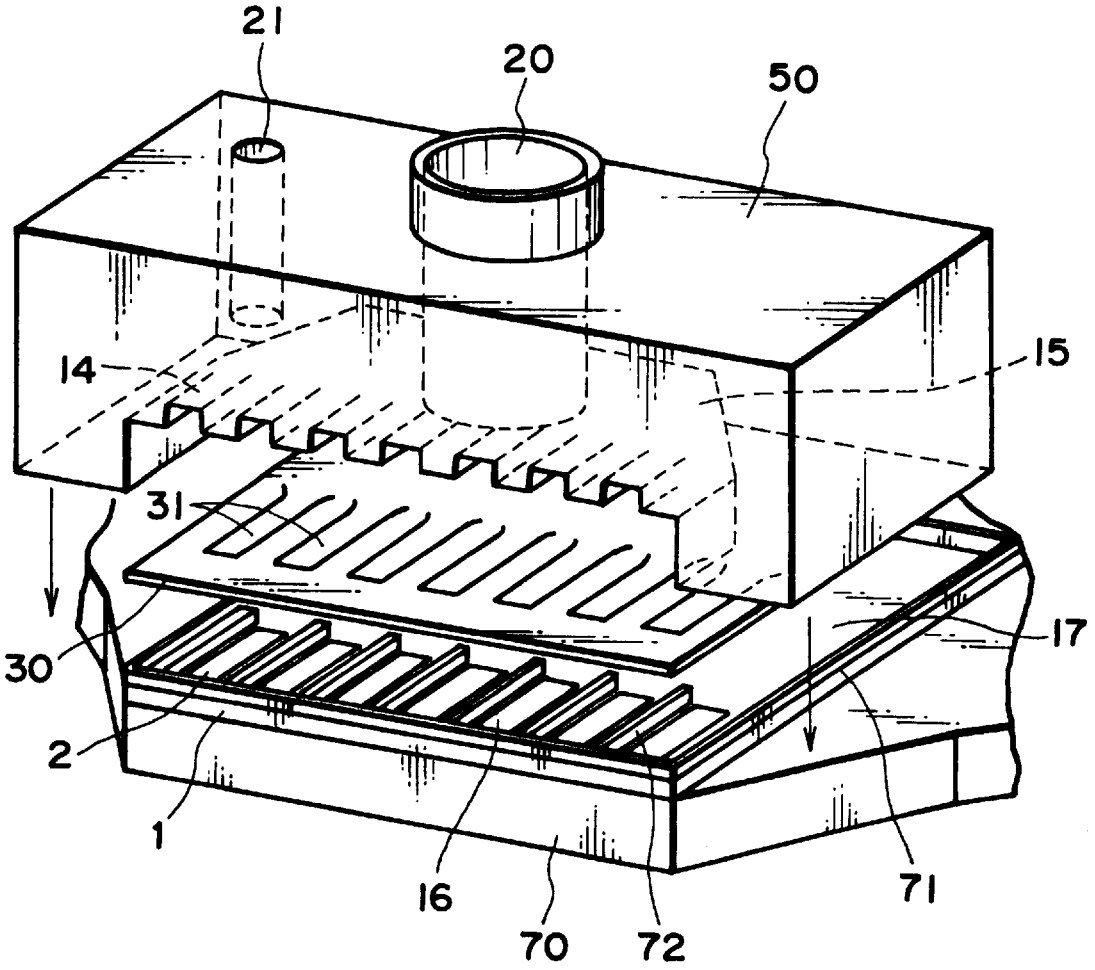
FIG. 37 is an exploded perspective view of a head applicable to the present invention.

FIG. 36 is a sectional view illustrating supply passage of a liquid ejecting head applicable to the present invention, wherein same reference numerals as in the previous embodiment are assigned to the elements having the corresponding functions, and detailed descriptions thereof are omitted for simplicity.

In this example, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14.

A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

As indicated by an arrow C in FIG. 36, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 36. In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

The second common liquid chamber 17 may be formed by dividing the grooved by a separation wall 30. As for the method of forming this, as shown in FIG. 26 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling. Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second common liquid chamber 17. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that movable members 31 are arranged corresponding to the heat generating elements on the element substrate 1, and that ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that stabilized ejection is accomplished.

<Ejection Liquid and Bubble Generation Liquid>

As described in the foregoing examples, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid. When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that ejection liquid by itself or by reaction with the bubble generation liquid, does not impede the ejection, the bubble generation or the operation of the movable member or the like. As for the recording ejection liquid, high viscous ink or the like is usable. As for another ejection liquid, pharmaceuticals and perfume or the like having a nature easily deteriorated by heat is usable.

The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

| Dye ink viscosity of 2 cp: | |
|---|---|
| (C.I. Food black 2) dye | 3 wt. % |
| Diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

| | |
|---|---|
| Bubble generation liquid 1: | |
| Ethanol | 40 wt. % |
| Water | 60 wt. % |
| Bubble generation liquid 2: | |
| Water | 100 wt. % |
| Bubble generation liquid 3: | |
| Isopropyl alcohol | 10 wt. % |
| Water | 90 wt. % |
| Ejection liquid 1: | |
| Carbon black | 5 wt. % |
| Pigment ink (viscosity of approx. 15 cp): | |
| Styrene-acrylate-acrylate ethyl copolymer resin material (oxide = 140, weight average molecular weight = 8000) | 1 wt. % |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Recording System>

Figure 38:
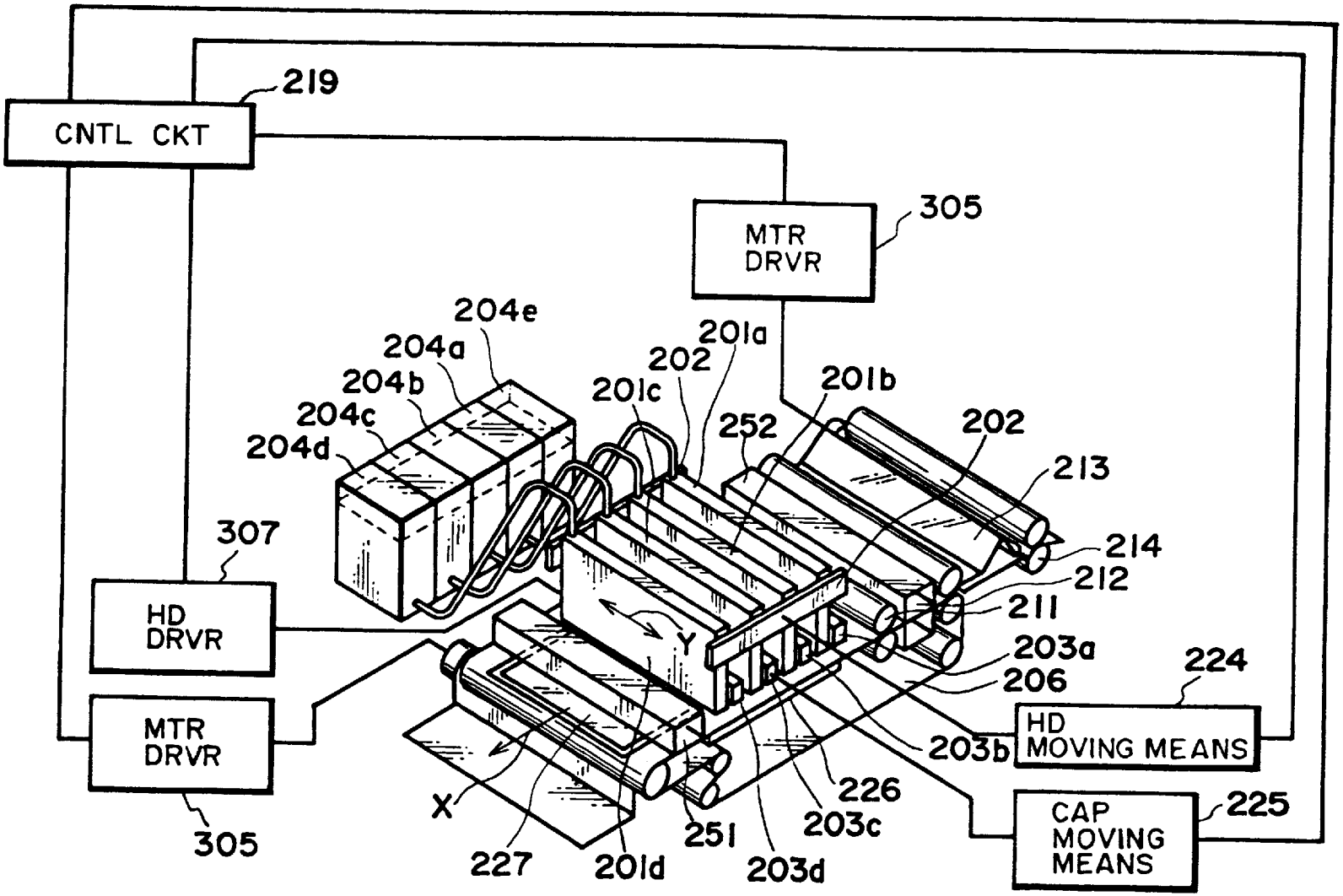
FIG. 38 is an illustration of a liquid ejection recording system.
Figure 39A:
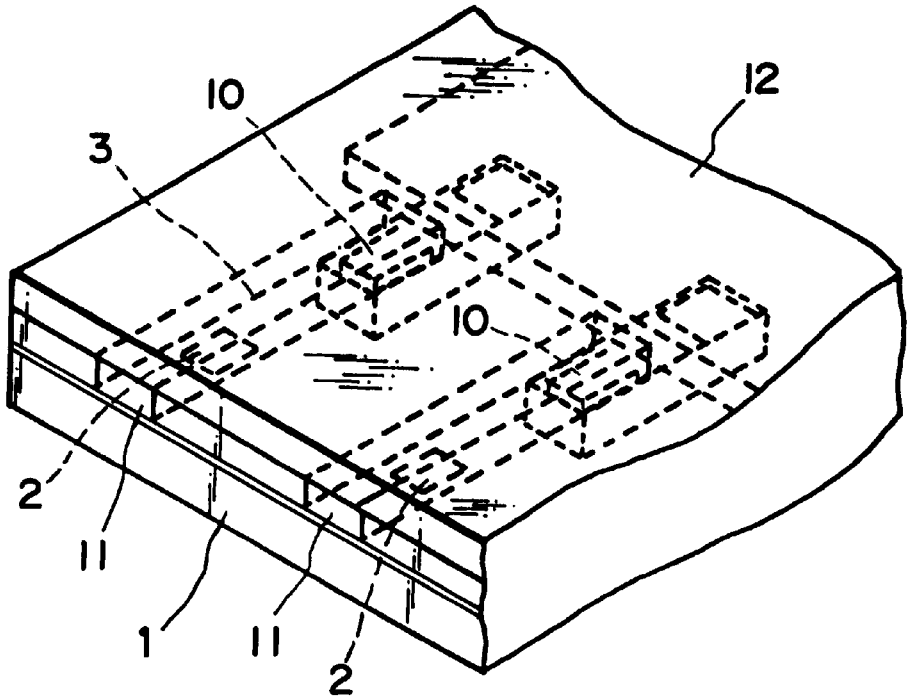
FIG. 39(a) PRIOR ART
FIGS. 39(*a*)–(*b*) are illustrations of a liquid flow passage structure of a conventional liquid ejecting head.
Figure 39B:
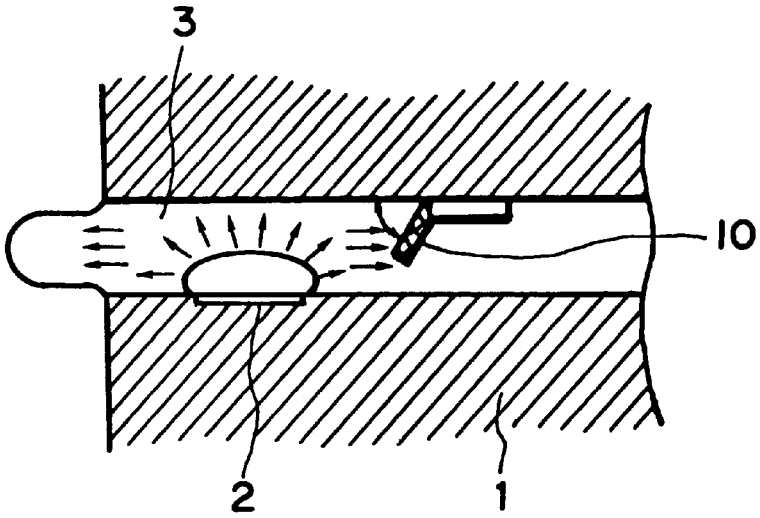
FIG. 39(b) PRIOR ART

An exemplary ink jet recording system applicable to the present invention, will be described, which records images on recording medium, using, as the recording head, the liquid ejection head in accordance with the present invention. FIG. 38 is a schematic perspective view of an ink jet recording system employing the aforementioned liquid ejection head 201 in accordance with the present invention, and depicts its general structure.

The liquid ejection head in this example is a full-line type head, which comprises plural ejection orifices aligned with a density of 360 dpi so as to cover the entire recordable range of the recording material 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head. A reference numeral 204*e* designates a bubble generation liquid container from which the bubble generation liquid is delivered to each head. The ink container in this system, has the structure similar to that shown in FIG. 22 of Embodiment 1.

Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording material such as those described in the preceding embodiments. The conveyer belt 206 is routed through a predetermined path by various rollers, and is driven by a driver roller connected to a motor driver 305.

The ink jet recording system in this example comprises a pre-printing processing apparatus 251 and a postprinting processing apparatus 252, which are disposed on the upstream and downstream sides, respectively, of the ink jet recording apparatus, along the recording material conveyance path. These processing apparatuses 251 and 252 process the recording material in various manners before or after recording is made, respectively.

The pre-printing process and the postprinting process vary depending on the type of recording medium, or the type of ink. For example, when recording material composed of metallic material, plastic material, ceramic material or the like is employed, the recording material is exposed to ultra-violet rays and ozone before printing, activating its surface. In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature. The pre-processing is not limited to this, and it may be the one to provide the recording material with the proper temperature. On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

The present invention is applicable to a so-called side shooter type head having an ejection outlet faced to the heat generating element surface.

According to the present invention, a liquid container for a single-liquid type can be mounted to a head, and therefore, the utility is enhanced by effectively using the liquid container, and the cost can be reduced. In addition, the two-liquid type container is not erroneously mounted to a one liquid type head.

The liquid ejecting operation or refreshing operation is carried out in accordance with the property of the liquid supplied from the correct liquid container, identifying the kind of the liquid container mounted to the two-liquid type head, so that high quality images can be printed.

If the liquid container for the two-liquid type is erroneously mounted tot single-liquid type head, the supply of the liquid from the two-liquid type liquid container is prevented.

While the invention has been described with reference to the structures disclosed herein, it is not confined to the details set forth and this application is intended to cover such modifications or changes as may come within the purposes of the improvements or the scope of the following claims.

What is claimed is:

1. A liquid supply system, comprising:

a first liquid ejection head for ejecting only a first liquid;

a second liquid ejection head for ejecting the first liquid and a second liquid which is more difficult to eject than the first liquid;

a first liquid container containing the first liquid, said first liquid container communicating with said first liquid ejection head and with said second liquid ejection head to supply the first liquid; and a second liquid container containing the second liquid, said second liquid container communicating with said second liquid ejection head to supply the second liquid, said second liquid container not connecting with said first liquid ejection head and not supplying the second liquid to said first liquid ejection head.

2. A liquid supply system according to claim 1 wherein said second liquid ejection head includes a first liquid passage in fluid communication with a liquid ejection outlet, a second liquid passage disposed adjacent to said first liquid passage and including a bubble generating region, a movable member disposed faced to said bubble generating region and displaceable between a first position and a second position, wherein different kinds of liquid can be supplied to said first and second passages, and said movable member displaces from the first position to the second position by a pressure produced by generation of a bubble in the bubble generating region to direct the pressure toward said liquid ejection outlet, so that the liquid is ejected through the liquid ejection outlet.

3. A liquid supply system according to claim 2, wherein said second liquid container contains the liquid supplied to said first liquid passage and the liquid supplied to the second liquid passage, separately.

4. A liquid supply system according to claim 2, wherein said second liquid ejection head is provided with a liquid inlet portion having a first and a second liquid inlets disposed adjacent to each other for permitting supply of the liquid to said first liquid passage and to said second liquid passage, said liquid inlet portion being provided with a filter, which is insertable into ink outlets of said first and second liquid containers.

5. A liquid supply system according to claim 2, wherein said second liquid container is provided with an engaging portion having a predetermined configuration at a liquid supply port including said first liquid supply port for supplying the liquid to the first liquid passage and a second liquid supply port for supplying the liquid to the second liquid passage which are adjacent to each other, and said second liquid ejection head is provided with a receptor portion for engagement with said engaging portion at a liquid inlet portion including a first and a second liquid inlets disposed adjacent to each other for permitting supply of the liquid to said first liquid passage and to said second liquid passage.

6. A liquid supply system according to claim 2, in which said first or said second liquid ejection head and said first or said second liquid container are separable.

7. A liquid container for use with a liquid supply system including a first liquid ejection head for ejecting a first liquid only, a second liquid ejection head for ejecting the first liquid and a second liquid which is more difficult to eject than the first liquid, a first liquid container for containing the first liquid, the first liquid container communicating with said first liquid ejection head and with said second liquid ejection head and supplying the liquid from said first liquid container, a second liquid container for containing the second liquid, said second liquid container communicating with said second liquid ejection head for supplying the liquid from said second liquid container, said second liquid container not connecting with said first liquid ejection head and not supplying the second liquid to said first liquid ejection head;

the improvement residing in that said first liquid ejection head is provided with a first liquid inlet for supplying the liquid thereto, and said second liquid ejection head is provided with a second liquid inlet for supplying the liquid thereto, and wherein said liquid container contains the first liquid, and is provided with a liquid supply port communicating with said first inlet and said second inlet to supply the liquid, so as to connect with and supply liquid to said first liquid ejection head and said second liquid ejection head.

8. A liquid container for use with a liquid supply system including a first liquid ejection head for ejecting a first liquid only; a second liquid ejection head for ejecting the first liquid and a second liquid which is more difficult to elect than the first liquid; a first liquid container for containing the first liquid, the first liquid container communicating with said first liquid ejection head and with said second liquid ejection head and supplying the liquid from said first liquid container, a second liquid container for containing the second liquid, said second liquid container communicating with said second liquid ejection head for supplying the liquid from said second liquid container, said second liquid container not connecting with said first liquid ejection head and not supplying the second liquid to said first liquid ejection head;

the improvement residing in that said first liquid ejection head is provided with a first liquid inlet for supplying the liquid thereto, and said second liquid ejection head is provided with a second liquid inlet for supplying the liquid thereto, and wherein said liquid container contains the second liquid, and communicates with the second liquid ejection head to supply the liquid thereto, and does not communicate with said first liquid ejection head and does not supply liquid to said first liquid ejection head.

9. A liquid supply system according to claim 8, wherein said second liquid ejection head includes a first liquid passage in fluid communication with a liquid ejection outlet, a second liquid passage disposed adjacent to said first liquid passage and including a bubble generating region, a movable member disposed faced to said bubble generating region and displaceable between a first position and a second position which is more remote from said bubble generating region than said first position, wherein different kinds of liquid can be supplied to said first and second passages, and said movable member displaces from the first position to the second position by a pressure produced by generation of a bubble in the bubble generating region to direct the pressure toward said liquid ejection outlet, so that the liquid is ejected through the liquid ejection outlet.

10. A liquid container as defined in claim 9, wherein said liquid container is provided with a projection capable of engaging only with an engaging portion provided in a container mounting portion of said second liquid ejection head.

11. A liquid container according to claim 8, wherein said separately second liquid container contains the liquid supplied to said first liquid passage and the liquid supplied to said second liquid passage.

12. A liquid container for use with a system according to claim 2, wherein said second liquid container is provided with an engaging portion having a predetermined configuration at a liquid supply port including a first liquid supply port for supplying the liquid to the first liquid passage and a second liquid supply port for supplying the liquid to the second liquid passage which are adjacent to each other, and said second liquid ejection head is provided with a receptor portion for engagement with said engaging portion at a liquid inlet portion including a first and a second liquid inlets disposed adjacent to each other for supply of the liquid to said first liquid passage and to said second liquid passage.

13. A liquid ejection apparatus, comprising:

a liquid ejecting head cartridge comprising a liquid ejection head and a liquid container device:

said liquid ejection head including;

a first liquid flow path in fluid communication with an ejection outlet;

bubble generation region;

second liquid flow path distributed adjacent said first liquid flow path;

a movable member disposed faced to said bubble generating region and displaceable between a first position and a second position more remote from said bubble generating region than said first position;

wherein said first and second liquid flow paths are capable of being supplied with different first and second liquids, respectively;

wherein said movable member is displaced from said first position to said second position by pressure produced by the generation of the bubble in said bubble generating portion to direct the pressure toward said ejection outlet, thus ejecting the liquid through said ejection outlet;

wherein said liquid container device for supplying the liquid to said liquid ejection cartridge, wherein said liquid container device may have a first liquid container accommodating at least said first liquid, or a second liquid container accommodating third liquid which is different from said first liquid and from said second liquid and which is to be supplied commonly to said first and second liquid flow paths, and wherein said first and second liquid containers are mountable the liquid ejecting head;

said apparatus further comprising:

carrying means for carrying said head cartridge;

wherein said first liquid container is provided with a plurality of electrode pads, and said second liquid container is provided with a plurality of electrode pads, and said carrying means is provided with electrode pins connectable with said electrode pads of said first and second liquid containers, wherein liquid container can be discriminated on the basis of state of connections of said pins and pads; and a control portion for controlling a liquid ejection refreshing operation, wherein said control portion effects different controls depending on whether the first liquid container or second liquid container is mounted.

14. An apparatus according to claim 13, wherein said control portion provides different bubble generating region in the liquid ejecting head depending on whether the first liquid container or second liquid container is mounted.

15. An apparatus according to claim 14, wherein said first liquid is an ejection liquid having a high viscosity; said second liquid is a bubble generation liquid; and said third liquid is an ejection liquid having a viscosity lower than said first liquid, and wherein said control portion provides driving power for bubble generation which is lower than driving power for said first liquid container when second liquid container is mounted.

16. An apparatus according to claim 13, wherein said control portion effects different sequences of refreshing operation depending on whether said first liquid container or second liquid container is mounted.

17. A liquid ejection control method for a liquid ejection head;

said liquid ejection head including;

a first liquid flow path in fluid communication with an ejection outlet;

bubble generation region;

second liquid flow path distributed adjacent said first liquid flow path;

a movable member disposed faced to said bubble generating region and displaceable between a first position and a second position more remote from said bubble generating region than said first position;

wherein said first and second liquid flow paths are capable of being supplied with different first and second liquids, respectively;

wherein said movable member is displaced from said first position to said second position by pressure produced by the generation of the bubble in said bubble generating portion to direct the pressure toward said ejection outlet, thus ejecting the liquid through said ejection outlet;

wherein said head is connectable to both of a first liquid container accommodating at least said first liquid, and a second liquid container accommodating third liquid which is different from said first liquid and from said second liquid and which is to be supplied commonly to said first and second liquid flow paths, and wherein said first and second liquid containers are mountable the liquid ejecting head;

said control method comprising the step of providing different bubble generating region in the liquid ejecting head depending on whether the first liquid container or second liquid container is mounted.

18. An apparatus according to claim 17, wherein said first liquid is an ejection liquid having a high viscosity; said second liquid is a bubble generation liquid; and said third liquid is an ejection liquid having a viscosity lower than said first liquid, and wherein said control portion provides driving power for bubble generation which is lower than driving power for said first liquid container when second liquid container is mounted.

19. A liquid ejection apparatus, comprising:

a liquid ejecting head cartridge comprising a liquid ejection head and a liquid container device:

said liquid ejection head including;

a first liquid flow path in fluid communication with an ejection outlet;

a bubble generation region;

a second liquid flow path distributed adjacent to said first liquid flow path;

a movable member disposed faced to said bubble generating region and displaceable between a first position and a second position more remote from said bubble generating region than said first position; and wherein said movable member is displaced from said first position to said second position by pressure produced by the generation of the bubble in said bubble generating portion to direct the pressure toward said ejection outlet, thus ejecting the liquid through said ejection outlet;

said apparatus further comprising:

mounting means for mounting said liquid ejecting head and said liquid container;

a control valve in fluid communication with said liquid ejecting head for selectively permitting or preventing supply of the liquid to said liquid ejecting head;

a control portion for controlling said control valve;

wherein said liquid container is provided with a plurality of electrode pads, and said carrying means is provided with electrode pins connectable with said electrode pads of said liquid containers, wherein said control valve is opened to permit supply of the liquid only when a predetermined connection state between said pins and pads are established.

20. An apparatus according to claim 19, wherein said control portion permits ejecting operation only when the predetermined connection state is established between said pins and pads.

* * * * *

UNITED STATES PATENT AND TRADEMARK OFFICE

CERTIFICATE OF CORRECTION

PATENT NO. : 6,106,111
DATED : August 22, 2000
INVENTOR(S) : Yoichi Taneya et al.

It is certified that error appears in the above-identified patent and that said Letters Patent is hereby corrected as shown below:

Title page,
Item [57], ABSTRACT,
Line 2, "including;" should read -- including: --;
Line 10, "first 1" should read -- first --; and
Line 24, "mountable" should read -- mountable on --.

Column 1,
Line 13, "with a movable member which" should read -- of a movable member which is --;
Line 39, "With such" should read -- Such --; and
Line 52, "demanded" should read -- demanded in order --.

Column 2,
Line 50, "extend." should read -- extent. --;

Column 3,
Line 11, "head" should read -- head of the --.
Line 23, "first 1" should read -- first --; and
Line 37, "the" should read -- on the --.

Column 4,
Line 9, "comprising:" should read -- comprises --;
Line 15, "including;" should read -- including --;
Line 29, "supply" should read -- supplying --.
Line 36, "device:" should read -- device, --;
Line 37, "including;" should read -- including --; and
Line 58, "the" should read -- on the --.

Column 5,
Line 3, "including;" should read -- including --;
Line 31, "including," should read -- including --; and
Line 52, "are" should read -- is --.

Column 6,
Line 12, "function" should read -- functions --.

Column 7,
Line 18, "FIGS. 18, (a) to (f) shows" should read -- FIGS. 18(a) - 18(f) show --;
Line 42, "of a" should read -- of --; and
Line 49, "a" should read -- between a --.

UNITED STATES PATENT AND TRADEMARK OFFICE

CERTIFICATE OF CORRECTION

PATENT NO. : 6,106,111
DATED : August 22, 2000
INVENTOR(S) : Yoichi Taneya et al.

It is certified that error appears in the above-identified patent and that said Letters Patent is hereby corrected as shown below:

Column 8,
Line 1, "39(a) (b)" should read -- 39(a) - (b) --;
Line 9, "example." should read -- example will be described. --;
Line 18, "this" should read -- of this --; and
Line 39, "photosensitivity" should read -- photosensitive --.

Column 9,
Line 39, "of the" (first occurrence) should be deleted.

Column 13,
Line 3, "b" should read -- by --; and
Line 35, "In FIG. 6," should read -- FIG. 6 --.

Column 16,
Line 60, "are" should read -- they are --.

Column 19,
Line 38, "the use is made with" should read -- use is made of --.

Column 20,
Line 9, "in" should read -- is --;
Line 20, "head" should read -- heads --; and
Line 38, "is" should read -- are --.

Column 22,
Line 6, "allows" should read -- allow --.

Column 23,
Line 60, "view" should read -- views --.

Column 26,
Line 35, "electrodes" should read -- electrode --.

Column 27,
Line 20, "pads," should read -- pins, --; and
Line 56, "0" should read -- θ --.

Column 29,
Line 51, "*thereof," should read -- thereof, --.

UNITED STATES PATENT AND TRADEMARK OFFICE

CERTIFICATE OF CORRECTION

PATENT NO. : 6,106,111
DATED : August 22, 2000
INVENTOR(S) : Yoichi Taneya et al.

It is certified that error appears in the above-identified patent and that said Letters Patent is hereby corrected as shown below:

Column 31,
Line 30, "is" should read -- are --;
Line 32, "relation ship" should read -- relationship --;
Line 33, "the" (second occurrence) should be deleted; and
Line 34, "with" should read -- of --.

Column 32,
Line 13, "determinate" should read -- determine --;
Line 57, "liquid" should read -- liquids --; and
Line 65, "material" should read -- material; --

Column 33,
Line 34, "width" should read -- width of --; and
Line 46, "reduces" should read -- reduced --.

Column 34,
Line 20, "grooved" should read -- grooved member --.

Column 35,
Line 49, "includes:" should read -- include: --.

Column 36,
Line 43, "Glyceline" should read -- Glycerine --.

Column 37,
Line 29, "material" should read -- materials --;
Line 50, "the" should be deleted; and
Line 51, "with" should read -- of --.

Column 38,
Line 19, "tot" should read -- to a --; and
Line 42, "claim 1" should read -- claim 1, --.

Column 39,
Line 44, "elect" should read -- eject --.

Column 40,
Line 21, "separately second" should read -- separable second --.

UNITED STATES PATENT AND TRADEMARK OFFICE

CERTIFICATE OF CORRECTION

PATENT NO. : 6,106,111
DATED : August 22, 2000
INVENTOR(S) : Yoichi Taneya et al.

It is certified that error appears in the above-identified patent and that said Letters Patent is hereby corrected as shown below:

Column 41,
Line 2, "the" should read -- on the --; and
Line 30, "when" should read -- when said --.

Column 42,
Line 4, "the " should read -- on the --; and
Line 15, "when" should read -- when said --.

Signed and Sealed this

Twenty-third Day of April, 2002

*Attest:*

*Attesting Officer*

JAMES E. ROGAN
*Director of the United States Patent and Trademark Office*